US005765756A

United States Patent [19]

Jordan et al.

[11] Patent Number: 5,765,756

[45] Date of Patent: Jun. 16, 1998

[54] ABRASIVE SLURRY JETTING TOOL AND METHOD

[75] Inventors: Gary D. Jordan, Richmond, Tex.; Martin A. Stulberg, Edmonton, Canada; Britt O. Braddick, Houston, Tex.

[73] Assignee: TIW Corporation, Houston, Tex.

[21] Appl. No.: 315,928

[22] Filed: Sep. 30, 1994

[51] Int. Cl.[6] ..... B05B 15/10

[52] U.S. Cl. ..... 239/204; 239/587.1; 239/587.4; 166/223

[58] Field of Search ..... 239/204, 247, 239/264, 587.1, 587.4; 175/424; 166/222, 223

[56] References Cited

U.S. PATENT DOCUMENTS

| | | | |
|---|---|---|---|
| Re. 31,495 | 1/1984 | Zublin | 166/223 |
| 2,796,293 | 6/1957 | Becker | 239/204 |
| 3,030,086 | 5/1962 | Donaldson et al. | 262/1 |
| 3,850,241 | 11/1974 | Hitchinson | 166/222 |
| 4,027,407 | 6/1977 | Kiss | 37/61 |
| 4,077,481 | 3/1978 | Bunnelle | 175/232 |
| 4,134,619 | 1/1979 | Bunnelle | 299/17 |
| 4,140,346 | 2/1979 | Barthel | 299/17 |
| 4,349,073 | 9/1982 | Zublin | 166/223 |
| 4,534,427 | 8/1985 | Wang et al. | 175/67 |
| 4,817,874 | 4/1989 | Jarzebowicz | 239/587.4 |
| 4,919,204 | 4/1990 | Baker et al. | 166/223 |
| 4,921,044 | 5/1990 | Cooksey | 166/222 |
| 5,181,578 | 1/1993 | Lawler | 174/424 |
| 5,195,585 | 3/1993 | Clemens et al. | 175/424 |
| 5,248,094 | 9/1993 | Munoz | 239/264 |
| 5,253,718 | 10/1993 | Lawler | 175/20 |
| 5,363,927 | 11/1994 | Frank | 166/223 |
| 5,445,220 | 8/1995 | Gurevich et al. | 166/223 |

FOREIGN PATENT DOCUMENTS

| | | | |
|---|---|---|---|
| 1382447 | 2/1986 | U.S.S.R. | 239/204 |
| 1716105 | 2/1992 | U.S.S.R. . | |
| 2239822 | 7/1991 | United Kingdom | 239/587.4 |

*Primary Examiner*—Andres Kashnikawa
*Assistant Examiner*—Lisa Ann Douglas
*Attorney, Agent, or Firm*—Browning Bushman

[57] ABSTRACT

A fluid jetting arrangement for fluid jetting a surface including a body (B) to receive jetting nozzle extenders (NE) which in one embodiment comprise a plurality of jetting nozzle extenders having voids there between providing surfaces for controlling the relative extension of the jetting nozzle extenders for moving a jetting nozzle extender having a jetting nozzle (16) with orifice (O) therein to position the jetting nozzle with the orifice (O) to fluid jet a surface and another embodiment wherein the jetting nozzle extender (NE) is integrally formed and positioned in the body (B) to fluid jet a surface.

82 Claims, 14 Drawing Sheets

ABRASIVE SLURRY JETTING TOOL AND METHOD

STATEMENT OF THE PRIOR ART

Various types of cleaning or cutting jet blasting arrangements have been proposed and used for jet blasting or eroding surfaces with abrasive fluids including, by way of example only, steam, water or any other fluid along with or without an abrasive substance in an attempt to accomplish whatever results may be desired.

Generally the fluids are conducted through a fluid passage in the arrangement and discharged through a restricted orifice in a jetting nozzle to increase the velocity of fluids and abrasive particles in an attempt to increase the cutting or cleaning effect desired. The jetting nozzle is available in a variety of designs and sizes and is normally produced from an extremely hard and/or tough material such as, by way of example only, carbide.

It is generally accepted that the closer a jetting nozzle is to the surface to clean or cut the higher the efficiency of the operation.

However, prior jetting arrangements have experienced relative short life due to the presence of abrasives in the fluid which cause cutting and washouts in the arrangement which has reduced, if not eliminated, their commercial viability.

Prior jet blasting arrangements , so far as known to applicants have not provided the ability to simultaneously jet blast in a plurality of radial directions and to selectively control the order as well as the amount of relative extension of the jetting components.

Prior jet blasting arrangements , so far as known to applicants, have not provided the ability to simultaneously jet blast in a plurality of longitudinal positions and to selectively and readily control the amount of relative extension of the jetting components.

Prior jet blasting arrangements, so far as known to applicants, have not provided the ability to simultaneously jet blast in a plurality of radial directions and a plurality of longitudinal positions and to selectively control the amount of relative extension of the jetting components.

Prior art jet blasting arrangements, so far as known to applicants, have not been able to inhibit wear of the components of the jet blasting arrangement due to the turbulence in the flow of abrasive fluid in the arrangements heretofore used while maintaining the flow volume required to accomplish the cleaning or cutting.

SUMMARY OF THE INVENTION

One object of the invention is to provide an arrangement which may be lowered through a restricted opening, such as, by way of example only, tubing which has a reduced internal diameter relative to well bore casing into which the tubing extends and then moving jetting nozzle extenders outwardly relative to the tubing to position a jetting nozzle for jet blasting a surface.

An object of the present invention is to provide an arrangement and method for jet blasting a surface remotely located relative to the apparatus wherein the extent of the jet blasting components may be varied to position a jetting nozzle in a desired relationship with the surface to be jet blasted.

Another object of the invention is to provide an arrangement and method for simultaneous jet blasting a surface in a plurality of desired radial and/or longitudinally spaced positions.

Yet another object of the invention is to provide in one form a jet blasting arrangement wherein a plurality of telescoped movable jetting nozzle extenders are pivotally supported in a body and are telescopically positioned together to enable the jetting nozzle extenders to be extended as desired.

A further object of the invention is to provide a jetting nozzle 10 extender which may comprise a plurality of jetting nozzle extenders or a single jetting nozzle extender.

Still another object of the invention is to support a plurality of telescoped movable jetting nozzle extenders for extension in a predetermined manner to accomplish jet blasting of a surface and retracting the extended movable extenders mechanically.

A further object of the invention is to retract telescopically arranged movable extenders without the use of fluid pressure.

A further object is to provide an integral jetting nozzle extender which includes a jetting nozzle with an orifice and member.

Another object is to provide a jetting nozzle extender where the orifice of the jetting nozzle is removably positioned in the jetting nozzle extender.

Yet another object is to provide a jet blasting arrangement which can be lowered through restricted access openings for operation in remote locations.

An object of the invention is to control or maintain the volume flow of abrasive laden fluid in a workstring and its transition to passage means in the jet blasting arrangement to maintain the turbulence of the abrasive laden fluid at a minimum as it is conducted through the jet blasting arrangement to reduce wear and cutting of the jet blasting arrangement Another object is to provide a passage means arrangement in a cutting and cleaning tool wherein the transition of volume flow of abrasive laden fluid from the workstring to the jetting nozzle means in the jet blasting arrangement is gradual, as opposed to sudden , to control or maintain the turbulence of the abrasive laden fluid at a minimum which inhibits erosion of the internal components of the arrangement as the abrasive fluid flows from the workstring through the jet blasting arrangement.

Still another object of the invention is to provide an arrangement having a flow that reduces the erosion of the internal components of a jet cleaning or cutting arrangement from the flow of abrasive fluid therethrough.

A further object of the invention is to provide a jet blasting arrangement which gradually reduces the volume of flow of abrasive fluid therethrough.

Another object of the invention is to provide a jet blasting arrangement which reduces the turbulence in the flow of abrasive fluid in the arrangement.

Another object is to provide a jet blasting arrangement wherein the amount of relative extension of plural movable jetting nozzle extenders supporting a jetting nozzle may be varied as desired.

Yet another object is to lock the component or components of a jet blasting arrangement in a position to inhibit damage by premature movement as the arrangement is lowered or positioned in a remote location, such as by way of example only, a well bore.

Other objects and advantages of the invention will become apparent from the following drawings and description.

Figure 1:
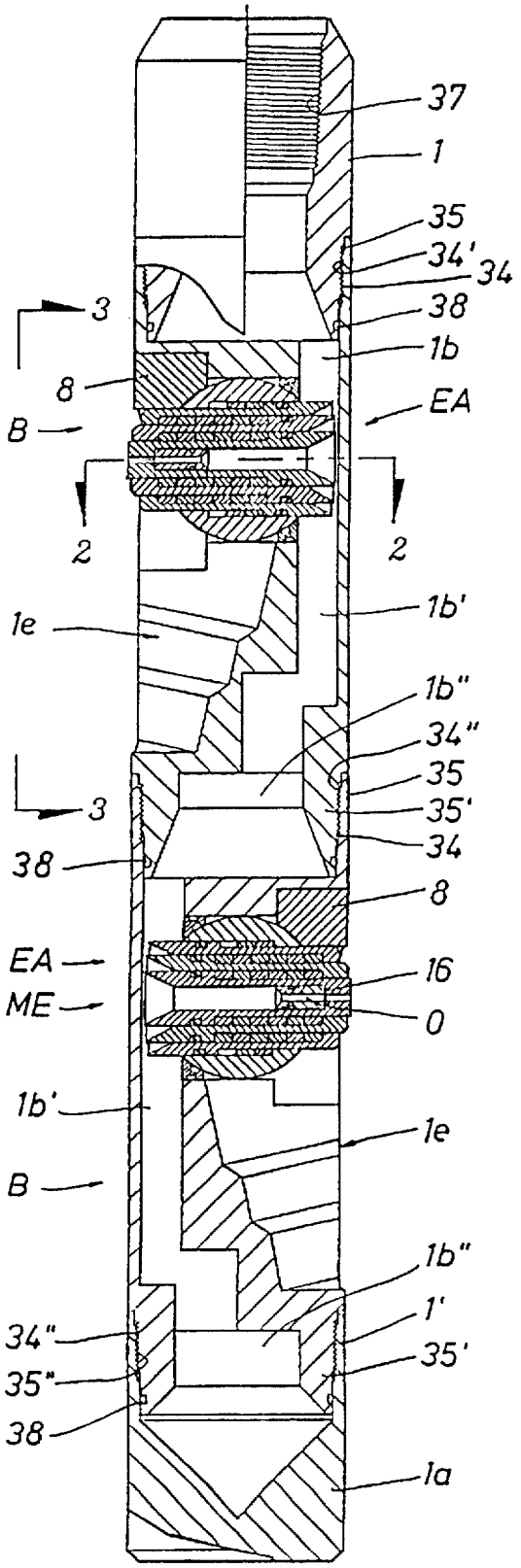
FIG. 1 is a half sectional schematic view with a quarter section schematic view at the upper end of the FIG. 1 showing one preferred form of the abrasive slurry jet tool arrangement (herein ASJ tool) with two connected bodies shown in a run in position with a set of movable jetting nozzle extenders for extending a jetting nozzle having an orifice relative to each of the bodies.
Figure 3:
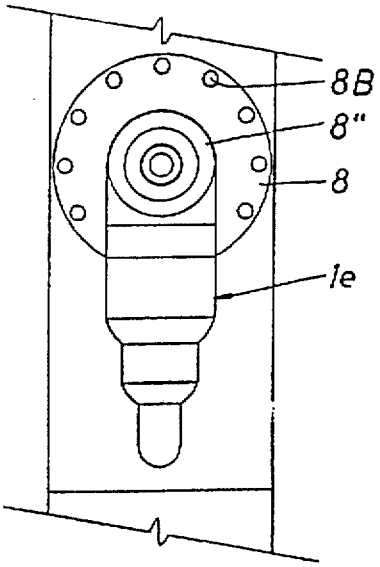
Figure 2:
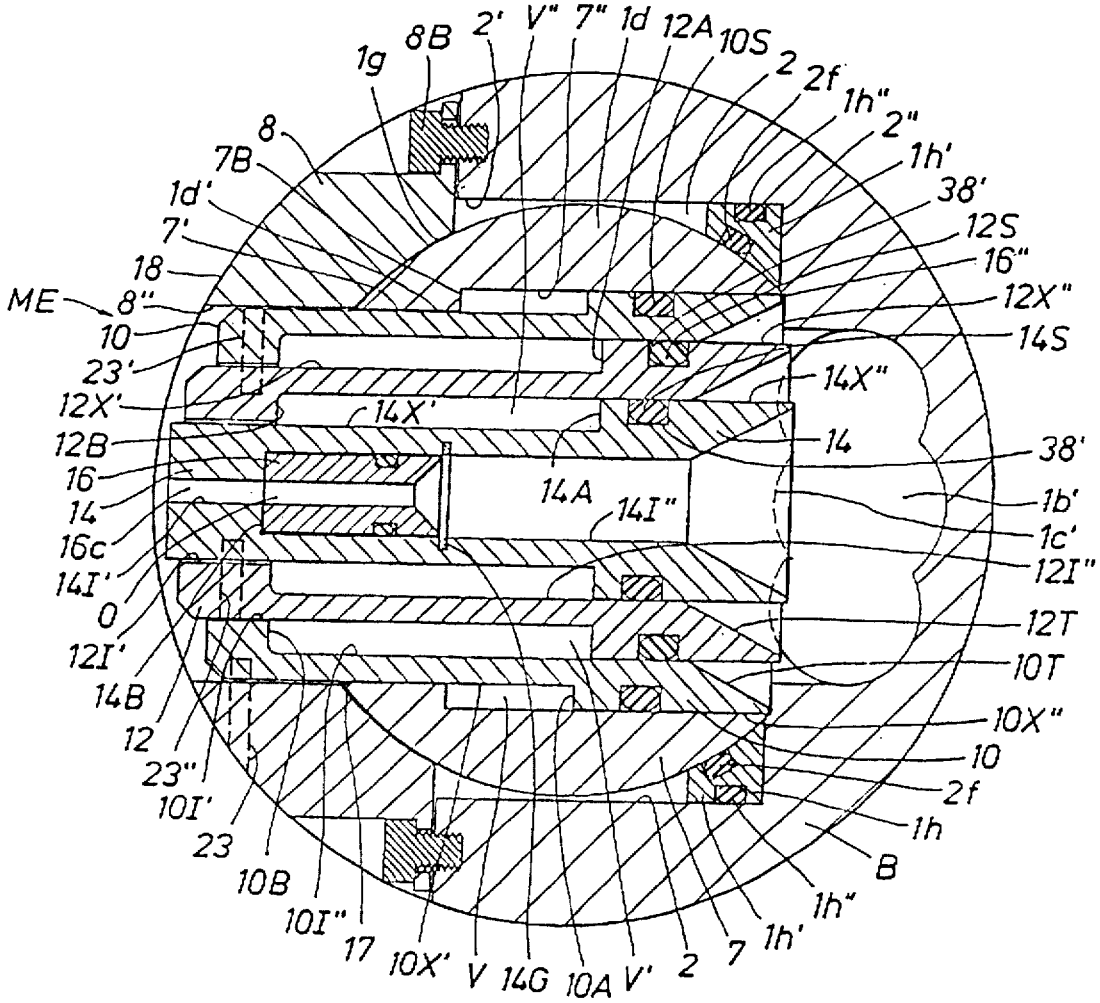
Figure 2A:
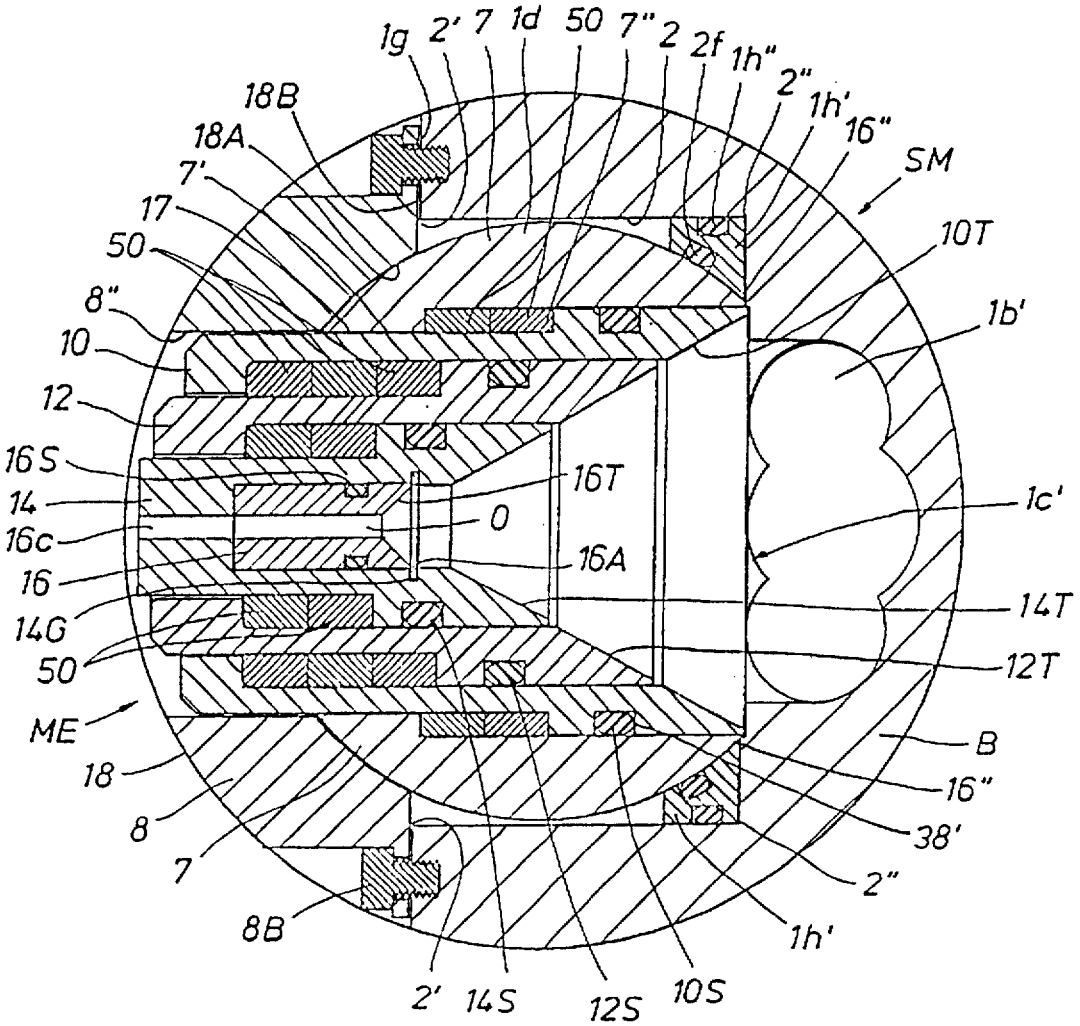
Figure 2B:
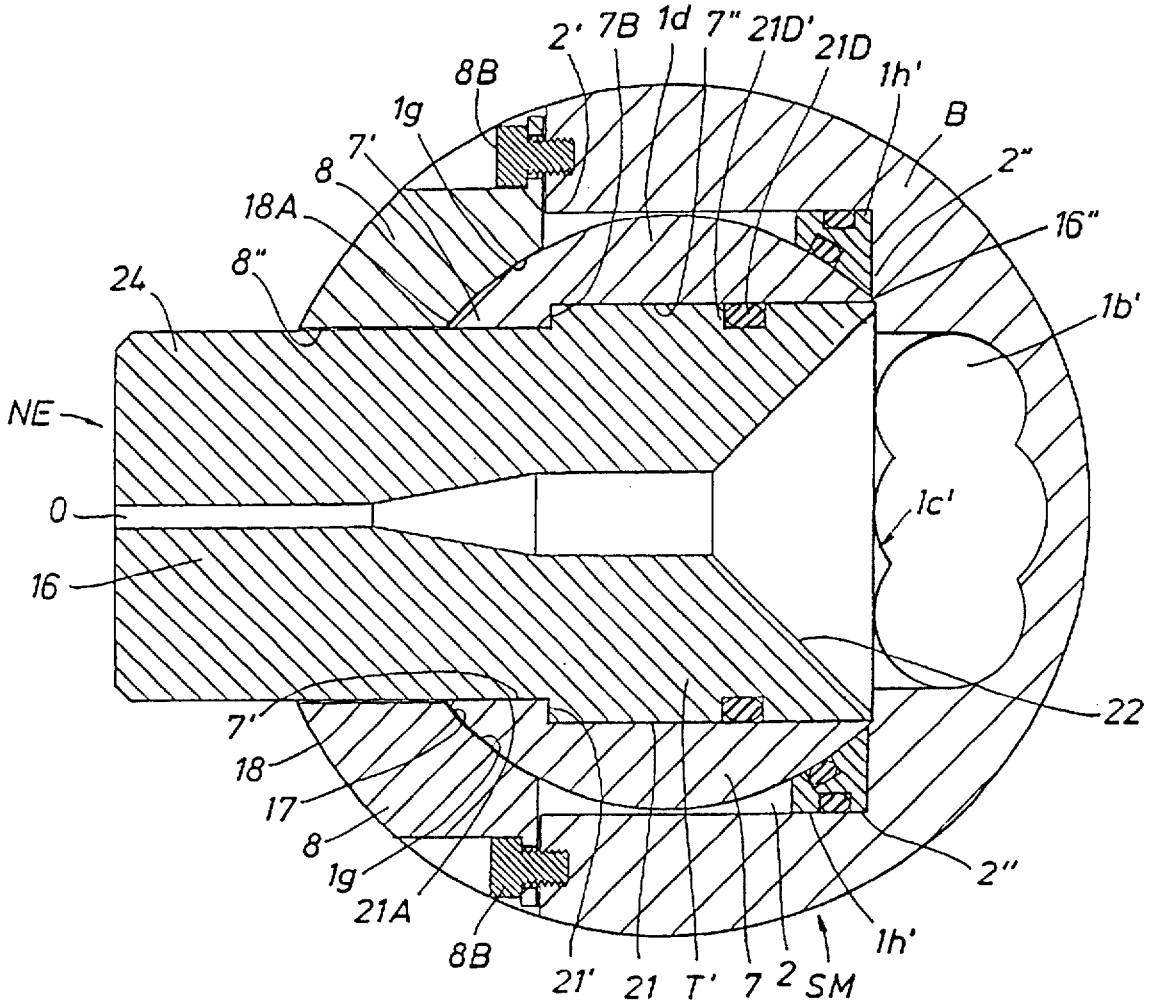
Figure 2C:
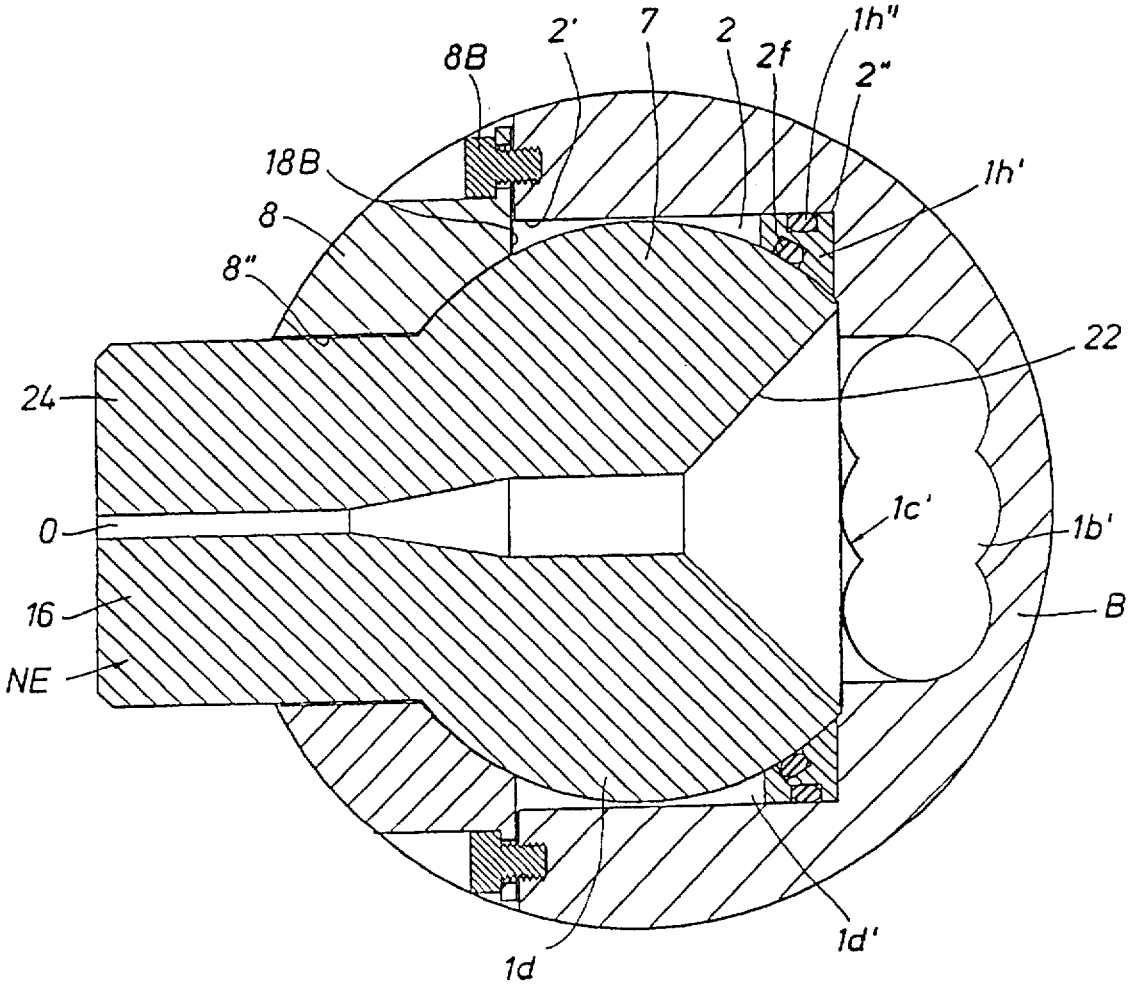
Figure 2D:
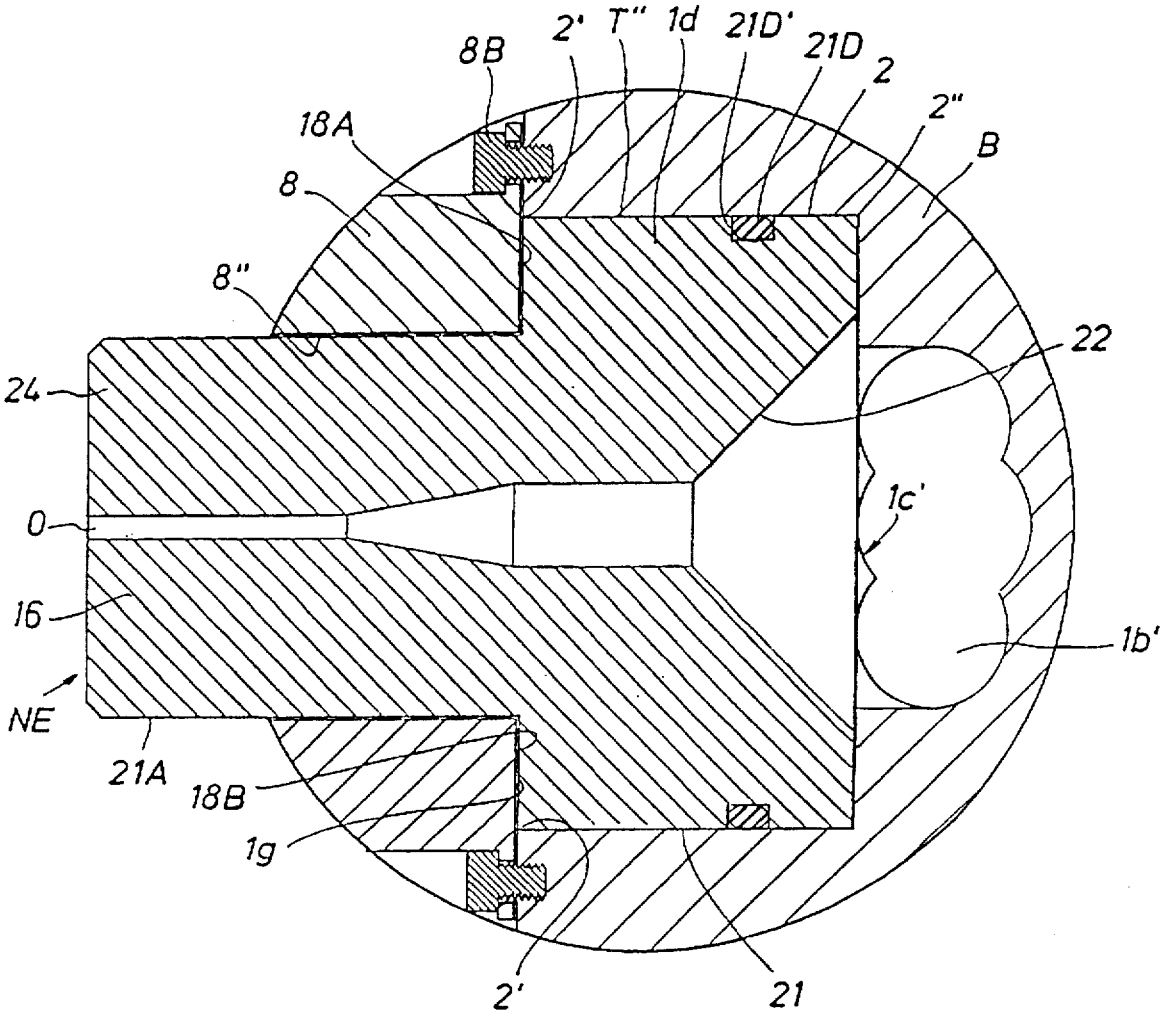

FIG. 2 is a cross sectional view on the line 2—2 of FIG. 1 showing a preferred arrangement of the movable jetting nozzle extenders to provide a gradual reduction in flow area and volume between fluid passage means in the body and the orifice in the jetting nozzle and shear pins to retain the movable jetting nozzle extenders retracted to prevent premature extension;

FIG. 2A is a cross section similar to FIG. 2 showing another arrangement for preventing premature movement and for controlling the extent of movement of the jetting nozzle extenders and jetting nozzle with its extender;

FIG. 2B is another cross section similar to FIG. 2 and showing a form of a stationary , or non-movable, single integral jetting nozzle extender integral with a jetting nozzle having an integral orifice and an integral protrusion positioned in a separate member with a spherical exterior surface;

FIG. 2C is a cross section similar to FIG. 2B showing a preferred form of an integral stationary, or non-movable, single jetting nozzle extender, where the member is integral with a jetting nozzle having an integral orifice and a partial integral exterior surface;

FIG. 2D is a cross section similar to FIG. 2B showing an alternate form of integral single jetting nozzle extender where the member has a tubular configuration and is integral with a jetting nozzle having an integral orifice;

FIGS. 2E–2H are each quarter section views illustrating various concentric bore and concentric counter bore configurations having various limit shoulder spacing with one form of the member of the support means and with and without spacer rings between the various bore and counter bore configurations to illustrate other various configurations to control the extent of movement of the jetting nozzle extenders;

FIG. 3 is a side elevation view on the line 3—3 of FIG. 1 showing the retaining cap removably secured to the body means and a recess that is in each body of the arrangement to receive the extended jetting nozzle extenders and jetting nozzle with its extender upon withdrawal of the ASJ from the location of use.

Figure 5:
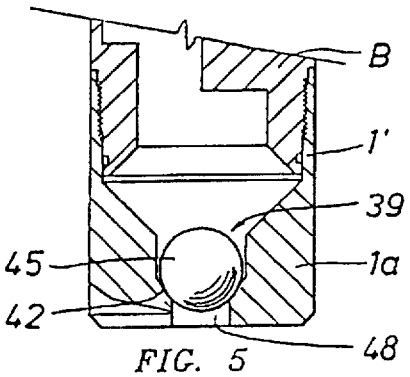
Figure 4:
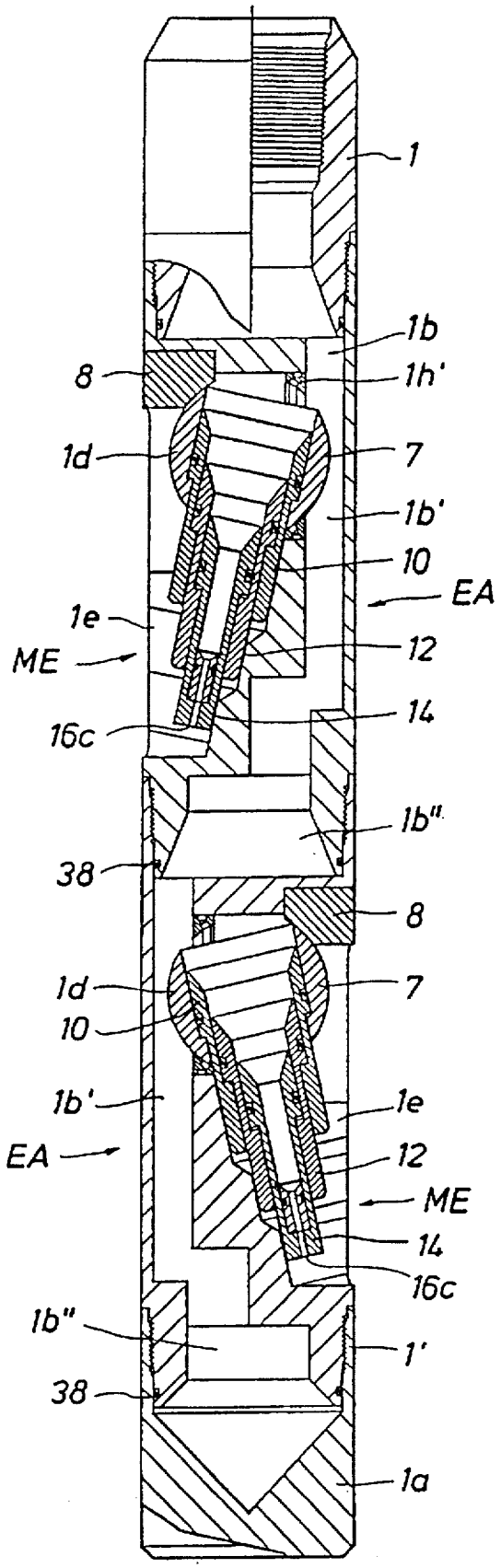
Figure 6:
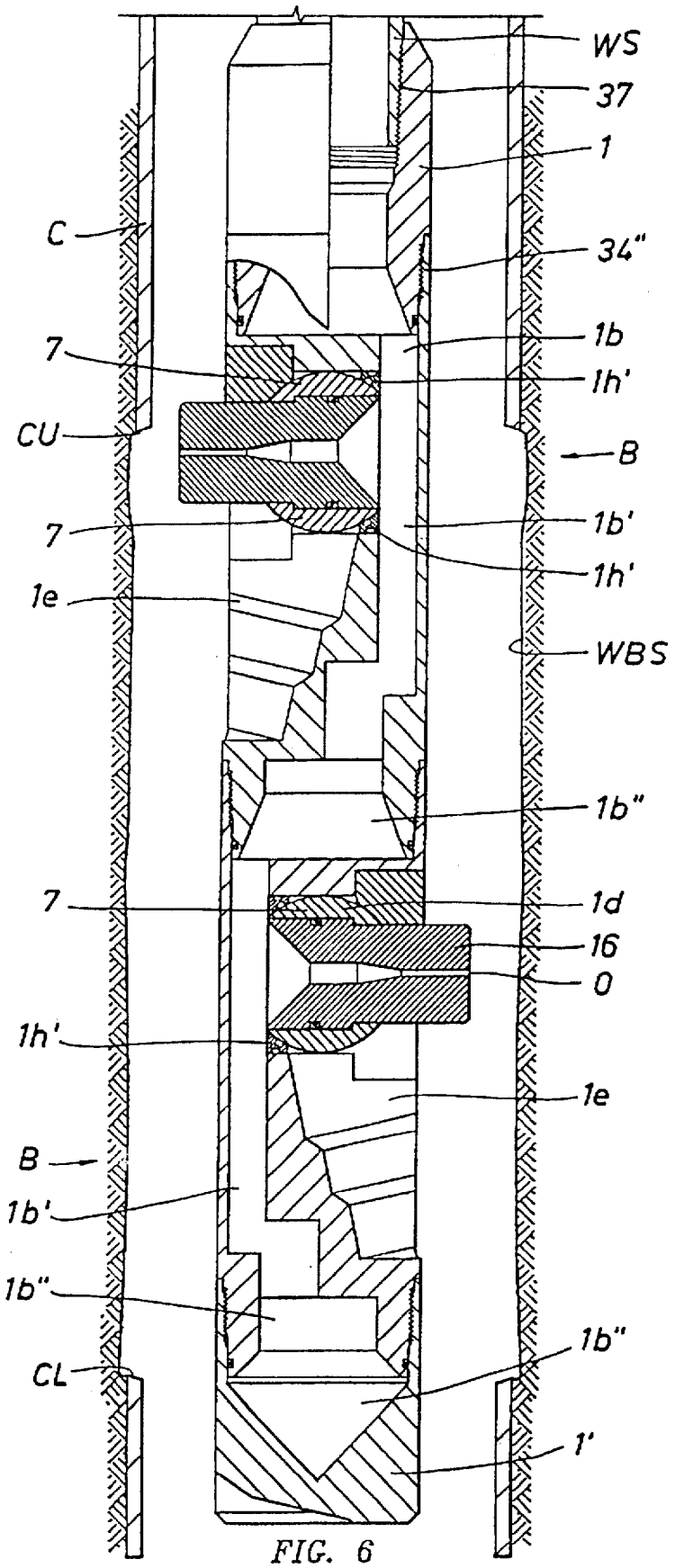
Figure 7:
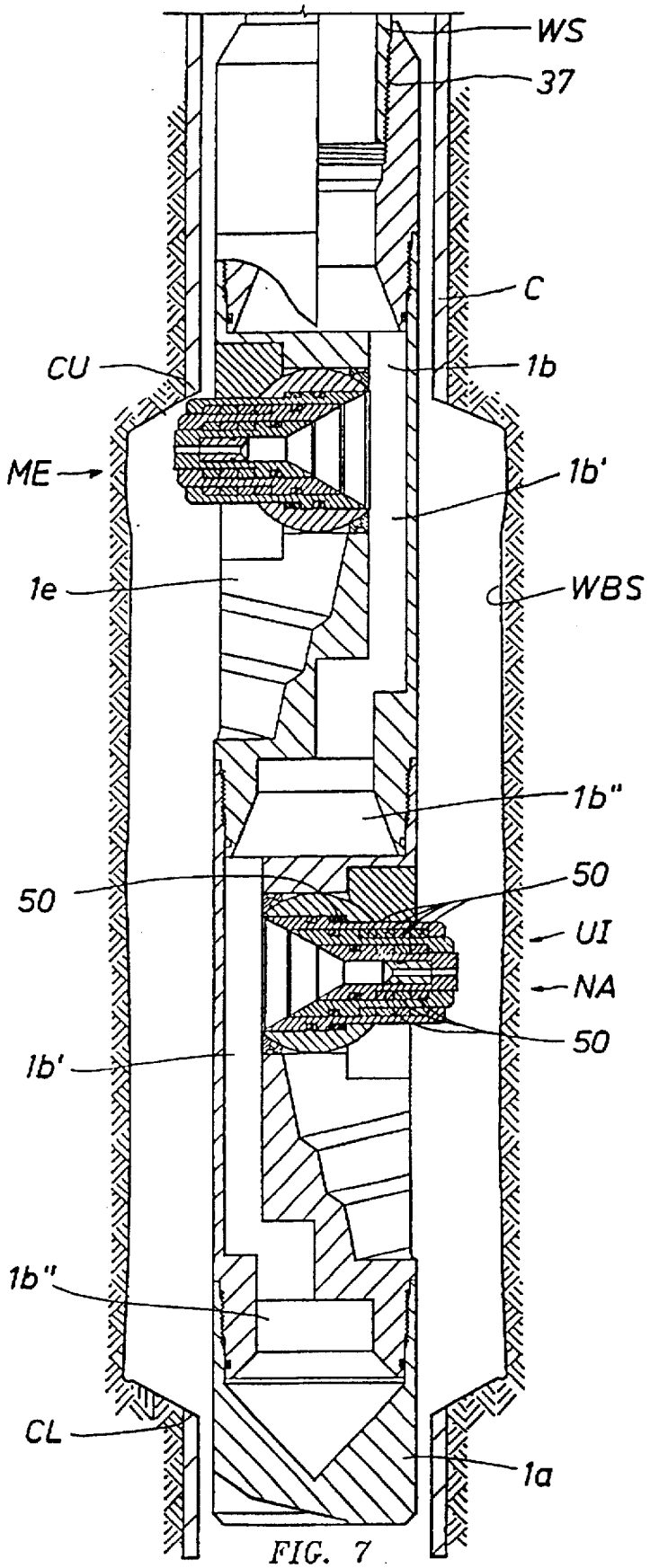
Figure 8:
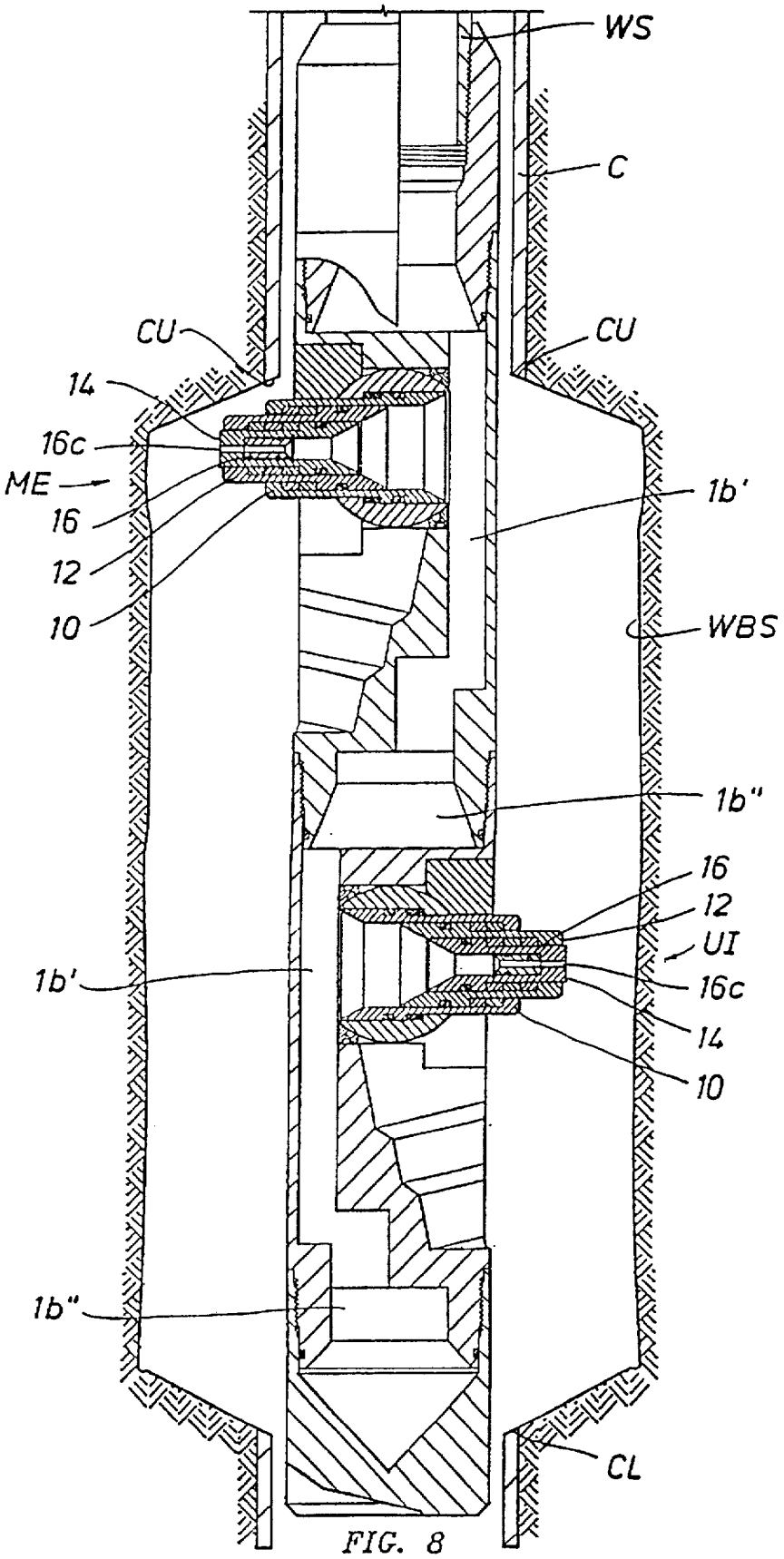
Figure 9:
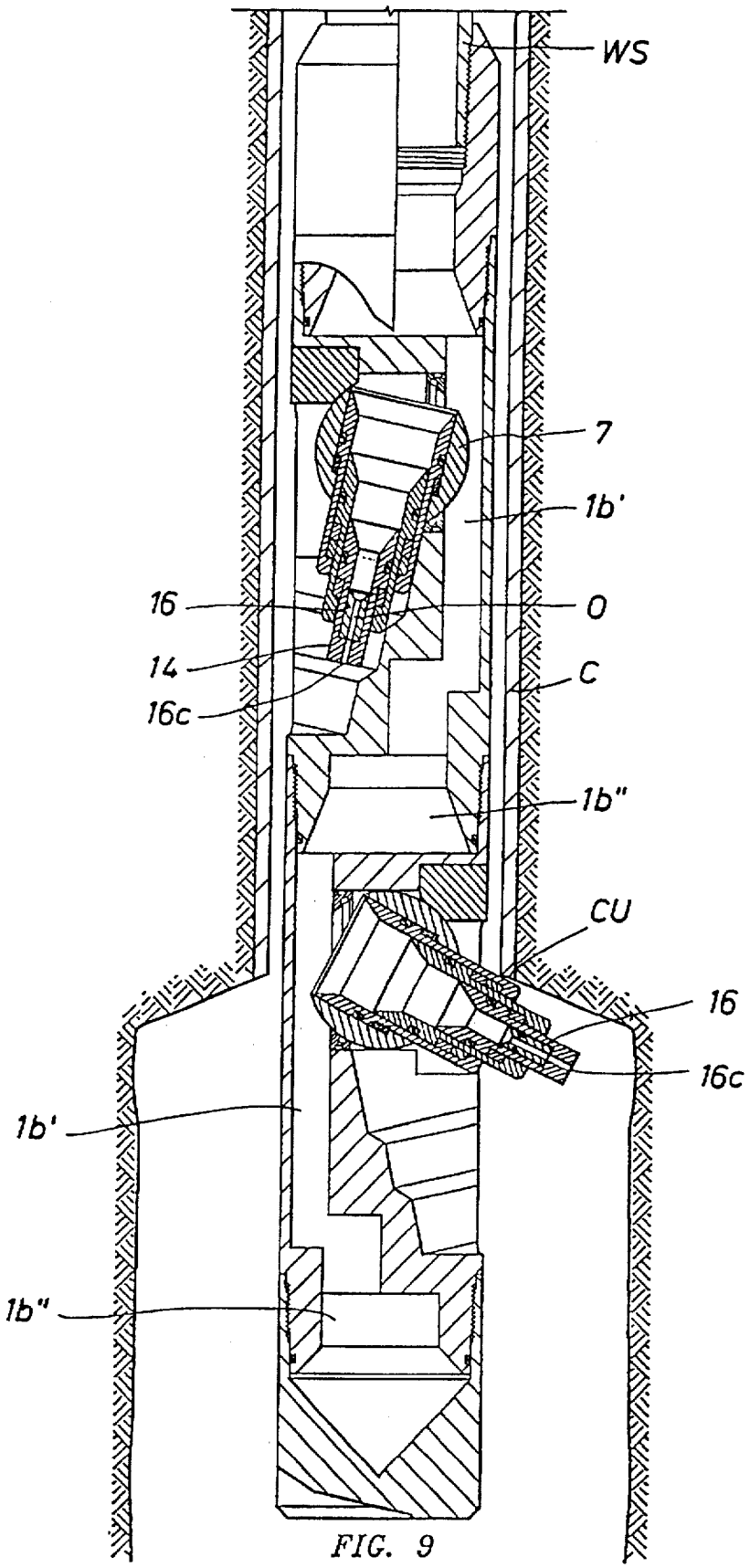
Figure 10:
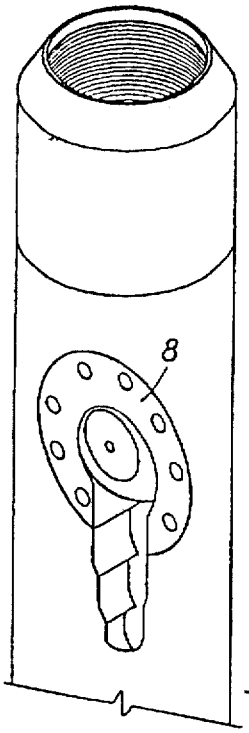
Figure 11:
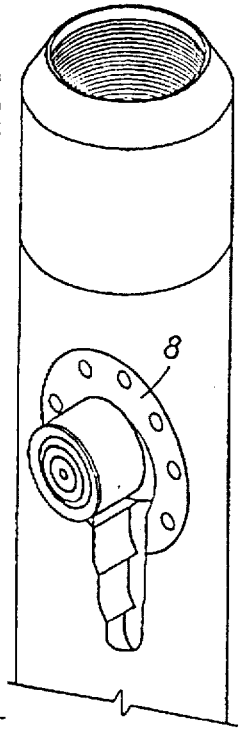
Figure 12:
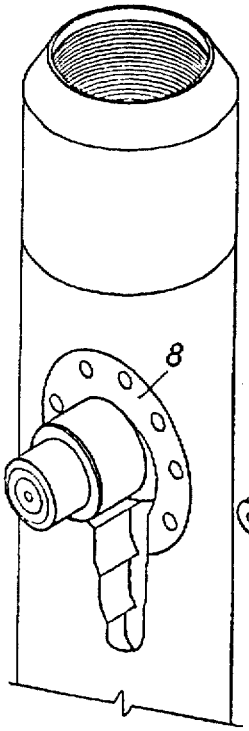
Figure 13:
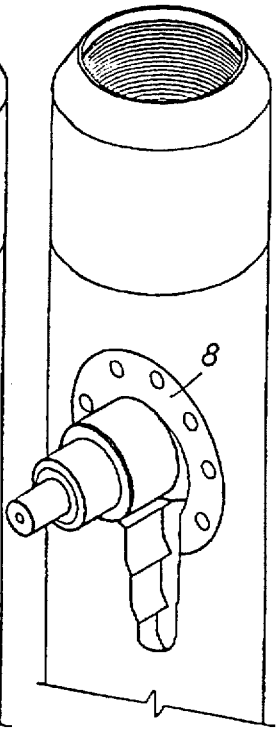
Figure 10A:
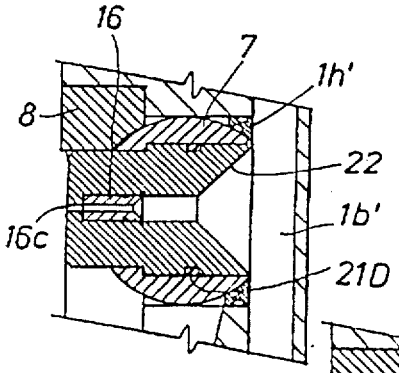
Figure 12A:
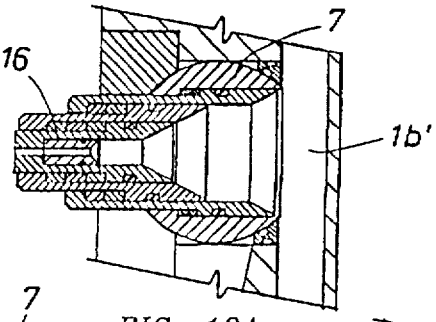
Figure 11A:
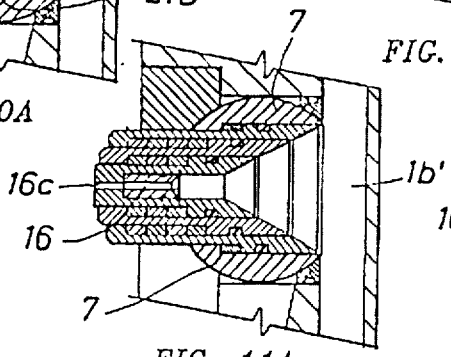

FIG. 4 is a half section view similar to FIG. 1 illustrating the fully extended position of the movable jetting nozzle extenders and jetting nozzle within the extenders when all the spacers are removed from each movable extender set of each connected body and are retracted into its respective body recess shown in FIGS. 1 and 3 for withdrawal of the ASJ tool from the well bore;

FIG. 5 is a partial half section schematic view showing an alternate form of the lower sub connected with a lower body;

FIG. 6 is a half section view of a well bore with a casing C which has a portion that has been eroded which exposes the adjacent well bore surface WBS with a half section view of the stationary integral single jetting nozzle FIG. 2B form in the ASJ tool in the well bore where it is not necessary to reposition the jetting nozzle relative to the surface to be cut or eroded after it is positioned in a remote location such as a well bore. This view also shows a portion of the casing C eroded to expose the well bore surface WBS;

FIG. 7 is a half section view similar to FIG. 6 of the ASJ tool showing a form of the movable jetting nozzle extender with some spacers removed (as compared with FIG. 1) and illustrating the movable jetting nozzle extenders in one extended position to urge the jetting nozzle and its extender outwardly in closer proximity to the surface to be cut, which surface in the drawing is the well bore surface WBS representing an under-reamed portion in the well bore adjacent a casing portion that has been eroded as shown in FIG. 6;

FIG. 8 is a half section view similar to FIG. 7 demonstrating another position of the movable extenders of the ASJ tool to further extend the jetting nozzle extender to further under-ream and enlarge the under reamed portion of well bore surface WBS adjacent the removed casing portion;

FIG. 9 is sectional view similar to FIG. 1 showing the movable jetting nozzle extenders of the movable extender form of the ASJ tool and the extended movable jetting nozzle extenders abutting or engaged with the upper end CU of the casing adjacent an under-reamed well bore portion when the workstring is elevated to move them to a retracted position in the recesses 1*e* in the body means as the workstring is elevated;

FIG. 10 is an isometric side view of the FIG. 2B stationary form with a removable jetting nozzle;

FIG. 10A is a schematic partial half section of FIG. 10 showing an alternate stationary FIG. 2B form with a removable jetting nozzle orifice in the jetting nozzle FIGS. 11–13 are isometric partial front elevation views schematically illustrating some of the various positions of the movable jetting nozzle extenders when some spacers are selectively removed from between the movable jetting nozzle extenders;

FIGS. 11A–13A are schematic half sectional views of FIGS. 11–13, respectively;

FIGS. 14–17 schematically illustrate some of the operations, by way of example only, which the ASJ tool may perform , including respectively casing erosion, and/or under-reaming, slotting a casing, forming a window in the casing and perforating a casing.

DESCRIPTION OF THE PREFERRED EMBODIMENTS

The present invention is described with several forms of jetting nozzle extenders, one form being telescoping or movable jetting nozzle extenders releasably or removably supported in a member in a body; a stationary, or non-movable, integral form removably or releasably supported in a member in a body and a stationary, or non-movable, integral form including the member.

The term "clean water" as used herein means water that does not have an abrasive substance, such as by way of example only, sand or any other abrasive particles or substance or medium, added to it.

The terms "stationary" and "non movable" as used herein means non-extendable or non telescoping. For example, the FIGS. 2B and 2C forms are non-movable, but are supported so that if the protrusion 24 of the non-movable forms shown in FIGS. 2B or 2C contacts the upper end CU of the casing as demonstrated in FIG. 9 during retrieval, they will pivot down to be received in a recess 1*e* in the body B, as demonstrated by the movable form of extenders in FIG. 9. In some instances, the internal diameter of the well bore casing may be large enough to enable the protrusion 24 to move therethrough upon retrieval.

The above and other forms of the ASJ tool will be described in detail, by way of example only and not by limitation, in use of the ASJ tool for removing a casing section, forming a window, slots or perforations in a well bore casing and removal or cleaning of a well bore formation surface to enhance production. It can be employed in other surface treating operations in any other situation and has particular application for treating surfaces that are remotely located from the operational location.

The present invention is described in a form for connection with a workstring to be lowered into a well bore which workstring may be drill pipe, tubing or coiled tubing depending upon the operation to be performed.

The various combinations of the member, limit spacers, jetting nozzle extenders and frangible pins described herein may be referred to on occasion herein as jetting nozzle assemblies or jetting nozzle sets.

Attention is first directed to FIG. 1 of the drawings where one form of the ASJ tool is shown.

In this description, one body, referred to generally by B of the body means is described, and the ASJ tool may have only one body B, or it may be formed of a plurality of bodies B connected together as shown in FIG. 1. Each body B includes the retainer cap 8 and each body B has the same components and configuration as described herein, and each body is identical except as noted and described herein.

Each body B in a jetting arrangement of the present invention has an open upper end and an open lower end which are threadedly connected with the upper and lower bushings 1 and 1', respectively, as shown in FIG. 1.

Each body B of the ASJ arrangement is provided with suitable means as shown in FIG. 1 for connecting the bodies B together and for connecting an upper sub or bushing 1 with the uppermost body B and for connecting a lower sub 1' with the lowermost body B, or where only one body is employed in the ASJ arrangement, for connecting the top or upper sub or bushing 1 with the upper end 35 of the body B and for connecting the lower or bottom sub or bushing 1' with the lower end 35' of the body B.

One suitable manner of connecting bodies B together is to connect the external threads 34" on the lower end 35' of a body B with the internal threads 34 adjacent the upper end 35 of a body B as seen in FIG. 1.

If only a single body B is employed in the ASJ arrangement, the upper sub or bushing 1 has external threads 34' which connect with internal threads 34 adjacent the top end of a body B. Internal threads 35" adjacent the upper end of lower bushing 1' connect with the external threads 34" on the lower end of body B. The lower sub or bushing 1', in the preferred from will have a lower end **1*a* with no opening therethrough or a one way valve arrangement referred to generally at 39 in FIG. 5, as will be described. The body B, except its retainer cap 8**, is preferably formed from solid bar stock having an outer surface which bar stock is machined, milled and drilled as necessary to form the body B.

The upper sub 1 on the uppermost body B has internal threads 37 adjacent its upper end as seen in FIGS. 6 and 7 for connection with a workstring WS as seen in FIG. 7, and external threads 34' adjacent its lower end for connection with the upper end of the next adjacent body B as shown in FIG. 1.

Where the ASJ tool has only one body B, the lower sub or bushing 1' with a closed end **1*a* connects with the lower end of the body B to close it off. Where the body B is formed of a plurality of bodies B, the lower sub or bushing 1' is threadedly connected with the lowermost body B. If desired the lower sub 1' may employ the configuration shown in FIG. 5**.

Each body B in the jetting arrangement includes passage means **1*b'* which communicates with the upper end of the upper body for receiving clean fluid or abrasive fluid for conducting it through the body B to discharge through the orifice O of jetting nozzle means 16** in the jetting arrangement.

The passage means **1*b*** preferably comprises generally longitudinally extending passages within each body B which intersect along their longitudinal extent and are shown, by way of example, as three intersecting passages.

The longitudinally extending, intersecting passage means **1*b*, of each body B has a portion 1*b'* which is eccentric that is represented by the connected arcuate dash-lines 1*c'* connected with the arcuate solid lines as shown in FIGS. 2–2D**.

The passage means **1*b* also includes a passage portion which is concentric as shown at 1*b"*** in the drawings relative to the central longitudinal axis of the body B for conducting clean fluid or abrasive fluid to the jet jetting nozzle extenders supported in each body B.

The passage means **1*b*** may assume any desired form which provides minimum restriction while providing gradual reduction in the volume of flow of clean fluid or abrasive fluid through each body to inhibit damage to the body and jetting nozzle arrangement by the flow of the abrasive fluid therethrough.

The passage means **1*b* in each lower body B, as seen in FIG. 1 communicates at their upper end with the concentric portion 1*b"*** of the passage means in the lower end portion of the adjacent upper body B. Similarly, fluid is conducted to any other connected body in the arrangement.

The passage means **1*b*, as seen in the drawings, cooperates with the chamfered jetting nozzle extender configuration to gradually ( as opposed to suddenly) reduce the fluid volume flow received from the workstring into the upper end of the uppermost body before the fluid reaches the orifice O of the jetting nozzle 16**.

The diameter, or size of the passage means, as a component in defining the volume of flow of clean fluid or of abrasive laden flow in the workstring in relation to the volume of the overlapping passages forming passage **1*b*** is such that the transition of volume flow of fluid from the workstring to the passage means in the jet blasting arrangement is gradual. This assists in controlling or maintaining the turbulence of fluid flow at a minimum which inhibits erosion of the internal components of jet blasting arrangement as fluid flows from the workstring through the jet blasting arrangement. The turbulence and erosion of abrasive laden fluid is more severe than clean fluid and the gradual volume of fluid flow and not sudden reduction of abrasive fluid flow between the workstring and the jetting nozzle orifice as above described assists in alleviating the turbulence problem.

The upstream end portion of the inner, intermediate and outer jet jetting nozzle extenders, 14, 12 and 10, respectively, respectively, and which receive the flow of fluid from the passage **1*b* in the body B, are tapered, or chamfered as illustrated at 14T, 12T and 10T, respectively in FIG. 2 to form a frustoconical end surface. The jetting nozzle orifice inlet end portion is chamfered as shown 16T in FIG. 2A to gradually reduce the flow of fluid from the passage 1*b*** before being received by the jetting nozzle orifice O.

As shown in FIG. 1 where two or more bodies B are connected together to form the ASJ arrangement, the concentric portion **1*b"*** of the longitudinally extending passage means in the lower end of a body B communicates fluid into the upper end of the next adjacent body B.

As shown in FIG. 5, an alternate form of the lower bushing 1' is shown which has a passage 48 through the normally closed lower end 1*a* of the lowermost sub or bushing on the lowermost body B in the arrangement, such passage having an annular surface 42 which forms a seat as illustrated in FIG. 5 for receiving a closure, such as a ball 45 to close off flow from the body B through the lower end of the arrangement of bodies B, but which permits reverse flow into and through the lowermost body B for reverse fluid circulation to the ASJ arrangement from a well bore in a manner well known to those skilled in the art into and through the body or bodies B of the ASJ tool and the workstring to unclog fluid passages in the event they become clogged due to the bridging effect of abrasive particles during normal operation of the ASJ tool.

Each body B, or bodies of the ASJ tool have a lateral hole which is preferably concentric relative to body B and is referred to at 2 in FIG. 2A and is preferably at a right angle relative to the longitudinal central axis of body B. The lateral hole has a second end 2' terminating adjacent the flat inner surface portion 18B of inner surface 18A of the retainer cap 8 as shown in FIG. 2A of the drawings and a first end 2" which terminates within the body B and adjacent the overlapping passages 1*c'* in the body B, as seen in the drawings.

The hole 2 is preferably circular or annular, but may be of any suitable shape and configuration for accommodating rotary or oscillatory movement of member 1*d* of the FIGS. 2 and 2A form for retraction of the movable extender form of the ASJ tool into the recess 1*e* of each body B upon removable of the ASJ tool from a well bore or other location.

Support means is referred to generally at SM in FIG. 2A, for the movable extender form and the integral stationary or non-movable extender form and comprises generally the body B, cap 8, member 1*d*, the details of which will be described, and seal means, as will be described, including seal means between the body B and the member 1*d* as seen in the drawings.

In the movable jetting nozzle extender form of the ASJ tool, shown in FIGS. 1,2, 2A, 4, and 7–9, the support means enables each extender assembly EA of movable jetting nozzle extenders, referred to generally at ME, in each body to accomplish the abrasive jetting and then the withdrawal or retraction of the extended movable jetting nozzle extenders 10, 12 and 14 into a recess as shown in FIG. 9, which recess is referred to generally at 1*e* formed in the bodies B as shown in FIGS. 1 and 3 for removal of the ASJ tool from a well bore.

In the stationary, or non-movable jetting nozzle forms shown in FIGS. 2B, 2C, 2D and 6, the support means maintains the fixed or stationary jetting nozzle in position in the body B while maintaining fluid integrity and gradual reduced flow volume from the workstring through the ASJ tool to the orifice O in the jetting nozzle 16.

Each body B in FIG. 1 is shown, by way of example only, as having only one group or one set of movable jetting nozzle extenders ME which forms an extender assembly referred to generally at EA for each body B, but the body means may be configured, or lengthened if necessary to accommodate a plurality of sets or groups of jetting nozzle extenders.

By way of example only, the member 1*d* is illustrated in the preferred form as a ball 7 with an annular, or spherical, surface better seen in FIGS. 2, 2A,and 2B of the drawings and is separate from, but receives a single movable jetting nozzle extender with a jetting nozzle 16 and its orifice O, or the plural movable jetting nozzle extenders as better seen in the FIGS. 2 and 2A forms and also receives the single integral jetting nozzle extender form as shown in the FIG. 2B form. The member 1*d* is integrally formed with the jetting nozzle extender and jetting nozzle 16 and its orifice O as seen in FIGS. 2B–2D.

A concentric opening 1*d'*, in member 1*d* is formed in the FIGS. 2, 2A, 2B, 4,and 6–13A forms by concentric bore 7' and concentric counter bore 7" which extend in member 1*d* to receive and support within the hole 2 of each body B an assembly of a plurality of concentric movable jetting nozzle extenders surrounding a jetting nozzle extender having a jetting nozzle 16 with an orifice O as shown in FIGS. 2 and 2A, or a single movable jetting nozzle extender with a jetting nozzle 16 having an orifice O, or a single integral non-movable jetting nozzle extender with a jetting nozzle 16 having an integral orifice as shown in FIGS. 2B, or a removable jetting nozzle 16 as shown in FIGS. 1, 2, 4, 7, 8, and 9–13A.

As shown in FIG. 2 of the drawings, the hole 2 has a second end 2' terminating adjacent cap 8 and a first end 2" terminating within said body means adjacent the inner surface of body B and adjacent overlapping passages represented at 1C'. Seal seat 1*h'* in positioned in hole 2 and seats on the body surface forming the inner end 2" of the hole 2. Seal seat 1*h'* supports seal 2*f* sealing between the seat and the outer annular surface of member 1*d* in the form of ball 7 and seal 1*h"* sealing between the seal seat and the adjacent surface in hole 2.

The concentric opening 1*d'* formed by bore 7' and counter bore 7" in member 1*d* terminates in an inner or upstream end 16" adjacent fluid passage means 1*b'* in the body B and an outer or downstream end 17 terminating adjacent opening 8" in the retainer cap 8, better seen in FIGS. 2 and 2B. The counter bore 7" extends from adjacent the eccentric fluid passage portion 1*b'* as better seen in FIGS. 2,2A and 2B and terminates at shoulder 7B.

In FIG. 2B, the integral, non-movable or non-telescoping tubular jetting nozzle extender T', also represented generally at NE in FIG. 2B has external annular surfaces 21 and 21A of different diameters which form shoulder 21' on extender NE which shoulder abuts shoulder 7B extending between the bore 7' and counter bore 7" on member 1*d* which is shown as a ball 7 and is separate from the integral jetting nozzle extender form of FIG. 2B and releasably supports the integral non-movable jetting nozzle extender NE in its fixed, or stationary, position in the member 1*d* as shown in FIG. 2B. Ball 7 is supported in the body B as described in the movable jetting nozzle extender form.

The integrally formed jetting nozzle extender form NE includes the jetting nozzle 16 with its integral orifice 0 and the inner end of the integral extender abuts, or is immediately adjacent the first end 2" of lateral hole 2 in body B adjacent the eccentric fluid passage means 1*b'* in body B and the jetting nozzle extender integral extension or protrusion 24 extends through the second end 2' of lateral hole 2 in the body B and through the matching circular or U shaped opening 8" in cap 8, as shown in FIG. 2D.

The integral form of FIG. 2B may have any outer surface configuration, but it is preferably annular as shown in the drawings. The cap 8 has an inner annular surface portion 18A that matches the adjacent spherical surface 1*g* of the ball 7 and a flat inner surface portion similar to that shown in FIG. 2A at 18B, that matches the flat end surface of body B at the end 2' of the hole 2 in the body B.

Bolts 8B releasably secure the retainer cap 8 in position on the body B. The radius of curvature of the outer surface 18 of cap 8 matches the outer surface of body B as shown in the drawings.

Seal means 21D in groove 21D' seal between the ball 7 and the integral jetting nozzle extender of FIG. 2B as seen in FIG. 2B. The seal means between the ball and body B are shown as including seal seat 1*h'* which has a surface configured to conform with the exterior surface of ball 7 and has a seal 2*f* to seal between the ball 7 and the seat ring and seal 1*h"* to seal between the body B and the seat ring 1*h'*, as illustrated in FIG. 2C.

FIG. 2B shows a body B with the eccentric fluid passage portion 1*b'* formed by longitudinally extending, overlapping passages represented generally by the dashed arcuate lines 1*c'* and solid arcuate lines which function as previously described to supply fluid to the orifice O of jetting nozzle 16.

FIG. 6 shows the FIG. 2B non-movable jetting nozzle extender form with two bodies that are connected together to form the body B.

In the FIG. 2B form, spherical member 1*d* in the form of ball 7 is separate from and releasably supports the tubular jetting nozzle extender T'.

The integral jetting nozzle extender arrangement of FIG. 2C includes member 1*d*, shown preferably as a spherical member, or ball, which arrangement is supported by cap 8 and body B with the seal seat 1*h'* and its seals therein. The cap 8 is provided with a flat internal surface 18B for abutting with the adjacent flat external surface at the end 2' of the lateral hole 2 in body B.

In the FIG. 2D form, the member 1*d* is integral with the jetting nozzle extender and jetting nozzle and is represented at T" in the preferred tubular form. This form is supported in the lateral hole 2 of the body B and by the cap 8.

Integral extension or protrusion 24 is supported by member 1*d* in the FIG. 2B form and the protrusion is of a length to extend through the outer end 17 of the member 1*d* and through the opening 8" in the cap 8.

In this form, the member 1*d* in the form of a ball is integral with the jetting nozzle extender T' including the jetting nozzle and its integral orifice O. Also, this stationary or non-movable form is supported in the lateral hole on the seal seat 1*h'* so that when the portion of the nozzle extender T' extending outwardly beyond the cap 8 contacts the casing upper end CU as demonstrated in FIG. 9, it will pivot into a recees 1*e* in the body B as demonstrated in FIG. 9 by the movable form of nozzle extenders.

The inner end 22 of the above integral arrangements of FIGS. 2B, 2C and 2D are each chamfered as shown at 22 in the drawings for receiving fluid flow from the eccentric passage portion 1*b'*.

In addition to the seal seat 1*h'* with the seals 1*h"* and 2*f* therein, annular groove 21D' receives seal 21D to seal between member 1*d* and annular surface 21 of tubular integral nozzle extender T' and between body B and integral nozzle extender T" as seen in FIGS. 2B and 2D, respectively, of the drawings.

FIG. 2C shows a preferred form of an integral single, stationary or non-telescoping jetting nozzle and its extender NE including an integral jetting nozzle 16 and its orifice O in the lateral hole 2 in body B. In this form, the member 1*d* in the form of a ball is integral with the jetting nozzle extender NE including the jetting nozzle and its integral orifice O. Also, this stationary or non-movable form is supported in the lateral hole on the seal seat 1*h'* so that when the nozzle extender NE extending outwardly through cap 8 contacts the casing upper end CU as demonstrated in FIG. 9, it will pivot into a recees 1*e* in the body B as demonstrated in FIG. 9 by the movable form of nozzle extenders.

The inner end of the integral jetting nozzle extender forms of FIGS. 2B, 2C, and 2D and the movable jetting nozzle extenders each abut, or are immediately adjacent the inner surface of body B adjacent the eccentric fluid passage means 1*b'* in body B and the jetting nozzle extender integral extension or protrusion 24 extends through the second end 2' of concentric hole 2 in the body B and through the matching opening 8" in cap 8, as shown in the drawings.

The retainer cap 8 is better seen in FIG. 3, and is provided with an internal surface portion as previously described which is configured with a shape 18A similar to the adjacent external surface 1*g* of the member 1*d* and an inner end surface portion 18B as better illustrated in FIG. 2A that matches the end 2' of the hole 2 in body B, so that the inner surface of the cap 8 conforms with the outer surface configuration of the member 1*d*, what ever that configuration may be, such as a ball, or spherical surface as illustrated in the drawings, or a flat end surface of body B in the FIGS. 2B, 2C and FIG. 2D to assist in supporting and maintaining the movable nozzle extenders and the integral non- movable form of nozzle extenders, regardless of their configuration, in operating position in the hole 2 of each body B.

Bolts 8B removably secure the cap in position on the body B as seen in FIG. 3. The outer surface 18 of the retainer cap 8 has a radius of curvature which, when fastened to the body B, matches the outside diameter of the body B.

The retainer cap is secured to each body B after the member 1*d* with the movable jetting nozzle extender assembly in opening 1*d'* thereof has been positioned in the lateral hole 2 of body B. Also, the cap 8 is secured with body B after the integral form of FIG. 2B has been positioned in the opening in ball 7 and the ball and integral form of FIG. 2B inserted in the concentric lateral hole 2 of body B, or after the FIGS. 2C and 2D forms are positioned in the lateral hole 2 of body B.

The configuration of the cap as better seen in FIG. 3 is generally horse shoe, or inverted U shaped which forms a circular or U shaped opening 8" in the cap as illustrated in the drawings, but it may assume any desired configuration which enables the movable jetting nozzle extenders to move therethrough from opening 1*d'* in member 1*d* while providing access to the recess 1*e* on the external surface of each body B to receive the extended movable jetting nozzle extenders when the arrangement is ready to be retrieved from the location where used.

Seal means are provided between the ball 7 and the body B and between the integral jetting nozzle extender of FIG. 2B and the member 1*d* as seen in FIG. 2C. The seal means between the ball and body B in FIG. 2C are shown as including seal seat 1*h'* which has a surface configured to conform with the exterior surface of ball 7 and has a seal 2*f* to seal between the ball 7 and the seat ring and seal 1*h"* to seal between the body B and the seat ring 1*h'*.

The movable jetting nozzle extenders may be of any shape, by way of example only, circular, square, triangular, polygonal or any other configuration with an opening therethrough and are telescoped one over the other for relative movement therebetween when positioned in the opening 1*d'* of member 1*d*, as shown in the drawings. The preferred form of the movable jetting nozzle extenders is tubular as shown in the drawings.

The concentric opening 1*d'* through member 1*d* has an inner end 16" adjacent the passage means 1*b'* with which inner end of the passage means 1*c'* communicates and the outer end 17 of member 1*d* is open to the exterior of said body B by communication through opening 8" in retainer cap 8 forming part of the body B as better seen in FIGS. 2 and 2A.

The opening 1*d'* may be of any suitable configuration to receive and accommodate movement of a jetting nozzle extender with jetting nozzle 16, or plural jetting nozzle extenders and a jetting nozzle 16 with its extender. In FIGS. 1–2C, 2E–2H, 4, 6–13A, the member 1*d* is shown with a spherical outer surface.

In the FIG. 2D form, the member 1*d* is tubular as represented at T" and is integrally formed with the jetting nozzle 16 having orifice O integrally formed therewith and the jetting nozzle extender for jetting nozzle 16.

The member T" in the FIG. 2D form has an exterior surface 1*g*configured to conform with the adjacent the inner surface flat 18B of retainer cap 8 which surfaces abut when the cap 8 is bolted to each body B as shown in the drawings to assist in retaining the member 1*d* in position in the hole 2 of body B.

The member 1*d*, is shown in FIGS. 1–2A, 2C, 2E–2H and 10–13A as a spherical ball 7 with a concentric bore 7' and a concentric counter bore 7" which form the opening 1*d'* through the member 1*d* in the above forms of the ASJ arrangement in which member the movable, or telescopically movable, jetting nozzle extenders ME, shown as tubular members by way of example only, are positioned. As noted previously, the opening Id' in member 1*d* will be configured to receive whatever the configuration of the movable, or telescopically movable jetting nozzle extenders and non movable jetting nozzle extender NE may be.

The assembly of plural movable jetting nozzle extenders ME slide, or move along relative to each other as they move from a telescoped relationship to a relative extended relationship, as will be described. The jetting nozzle extenders NE are movable from a radially inward position as shown in FIGS. 2 and 2A to a radially outward position as shown in FIGS. 7, 8, 11A, 12A and 13A.

The support means SM for the member 1*d* in all forms shown, except for the FIG. 2D form includes basically the body B with the seal seat 1*h'* in the hole 2 therein, the member 1*d* and the retainer cap 8 removably secured to the body B by bolts 8B at the second, or outer end of the hole 2 in the body B, or may be secured by threads to the body B The cap engages, or is in close proximity to the adjacent surface 1*g* of the member 1*d*, as previously described and is releasably secured to the body B adjacent the outer end of hole 2. As seen in FIG. 2 and as noted previously, the retainer cap 8 has a circular opening 8" which matches and communicates with the concentric opening 1*d'* in member 1*d* as shown in the drawings of the above forms.

The seal seat 1*h'* in the FIGS. 2–2C is an annular support or seal ring, which has a surface that conforms with and abuts the adjacent surface of member 1*d* when it is positioned in the hole 2 as seen in FIGS. 2–2C. The seal seat member supports a seal 1*h"* that seals between the seal seat, or seal support and the body B adjacent the passage 1*c'* and a seal 2*f* that seals between the seal seat and the member 1*d* adjacent the overlapping passages 1*c'*, as seen in FIGS. 2–2C.

The inner end of the FIG. 2C integral arrangement is chamfered as represented at 22 adjacent the eccentric fluid passage portion 1*b'* and functions as previously described to gradually reduce fluid volume flow to the jetting nozzle orifice O.

The jetting nozzle 16 is positioned on the shoulder formed by the termination of and juncture of large internal bore 14I" with smaller concentric internal diameter 14I' in outer jetting nozzle extender 14. A reduced diameter fluid passage 16C extends through the shoulder and through the outer end of outer extender 14 as seen in FIG. 2.

The jetting nozzle 16 has an orifice O extending therethrough which communicates with the diameter 14I" at the inner, or inlet end of orifice O and the fluid passage 16*c* at the outer, or exit end of orifice O. A seal 16S is between the jetting nozzle and the internal bore diameter 14I" of the jetting nozzle extender 14.

The jetting nozzle 16 is shown as removably secured in the bore diameter 14I" of outer jetting nozzle extender 14 by a snap or lock ring 16A engaging the internal radial groove 14G in bore diameter 14I" at the inner end of jetting nozzle 16 nearest the fluid passage portion 1*b'*, as seen in FIG. 2A.

Conforming with the gradual reduction of fluid volume flow through the ASJ tool, the jetting nozzle 16 has an internal outwardly chamfered surface 16T on its inner end facing toward the eccentric fluid passage 1*b'* as seen in FIG. 2A.

In the integral form of the jetting nozzle extenders, the jetting nozzle 16 may be integral with the jetting nozzle extender 14, and member 1*d* or the jetting nozzle extender and the member may be integral, with a removable jetting nozzle.

The movable jetting nozzle extenders in the preferred form include an inner, an outer and one or a plurality of intermediate movable jetting nozzle extenders between the inner and outer jetting nozzle extenders.

The member 1*d* and its support means, in some forms as described and shown in the drawings, are configured to be supported in the hole 2 of the body to accommodate rotation or oscillation of the member 1*d* relative to the body B as better seen in FIG. 9 of the drawings.

When it is desired to remove the ASJ tool from a well bore, or other remote location after the movable jetting nozzle extenders have been extended, the ASJ tool is raised by the workstring whereupon the extended jetting nozzle extenders will contact either the lower end CU of the casing C in a well bore or the earth's surface immediately above the extended jetting nozzle extenders as the ASJ tool is lifted upwardly or withdrawn by the workstring for removal from a remote location, such as the well bore.

Contact of the extended extenders with a surface as the workstring moves up causes the extended inner, intermediate and the outer jetting nozzle extenders to move, or pivot down and retract into the recess 2*e*, which recess 2*e* extends longitudinally on the outer surface of the body B and is aligned with and below the circular opening in cap 8. This enables the ASJ tool to be retrieved from whatever remote location in which it has been used.

The jetting nozzle extender arrangements also referred to generally at NE may form only a single jetting nozzle extender having removable nozzle orifice O and a single movable nozzle extender. The arrangement may include a single integral jetting nozzle, nozzle orifice and member 1*d* as previously described which is fixed in the body B.

The telescoped movable jetting nozzle extenders are shown as tubular, but as previously noted, they may assume any desired configuration and their exterior surface configuration preferably conforms with the configuration of the internal surface in opening 1*e* in member 1*d* to accommodate relative movement therebetween.

Each set, or assembly, of movable jetting nozzle extenders, referred to generally at NA may be considered, in the preferred form, as having an inner movable jetting nozzle extender 10, an outer movable jetting nozzle extender 14 and at least one intermediate jetting nozzle extender 12 between the outer jetting nozzle extender 14 and inner jetting nozzle extender 10.

When additional intermediate jetting nozzle extenders are employed, each is progressively smaller in diameter to cooperate in positioning the jetting nozzle extender 14 with the orifice O therein outwardly and further from the vertical center of the ASJ to perform a desired function on a surface. It may be necessary to provide a longer hole 2 in body B and a longer opening in member 1*d* to accommodate the additional movable jetting nozzle extenders.

The number of movable jetting nozzle extenders is limited only by the size of the body B, the size of the hole 2, and the size of opening 1*d'* in the member 1*d*.

The movable jetting nozzle extenders each have an inner end adjacent the eccentric passage portion 1*b'* and an outer end initially adjacent cap opening 8" as shown in the drawings.

Figure 13A:
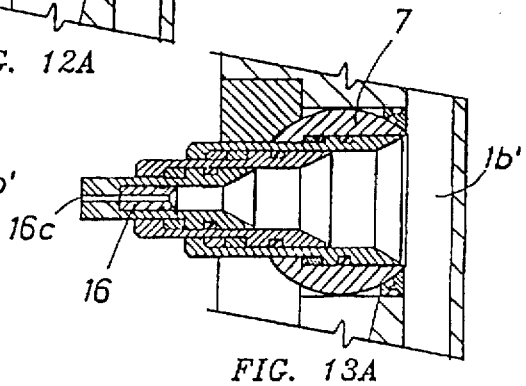

Other components of the form shown in the drawings may be adjusted accordingly, if necessary to accommodate the larger number of movable extenders. In the form illustrated in the drawings, the body B has an external, or outer diameter of 6 inches. Where smaller or larger body sizes are used, the components of the present invention as illustrated in the drawings will remain, but their size and arrangement may vary to conform with the size of the body in which they are employed. When in the fully radially inward position as shown in FIGS. 2, 2A, and 10, each jetting nozzle is housed within the body B, the jetting nozzle is intersected by the central axis of the body B, and a radially exterior surface of the jetting nozzle is positioned radially inward of an exterior surface of the body B. When in the fully radially outward position as shown in FIGS. 13 and 13A, the jetting nozzle discharge aperture or orifice O is at least substantially exterior of the body B.

In the movable jetting nozzle extender form of the ASJ tool shown in the drawings, voids V,V' and V", are formed, respectively, between and within the member 1*d* and adjacent inner jetting nozzle extender 10, between and within the inner jetting nozzle extender 10 and intermediate jetting nozzle extender 12, and between and within the intermediate jetting nozzle extender 12 and outer nozzle extender 14, respectively.

FIGS. 2, 2A, 2B and 2C show member 1*d* as a spherical ball 7, with the ball integral with the jetting nozzle extender and non movable in FIG. 2C.

The ball member 7 in FIGS. 1, 2, 2A and 2E–2H has a concentric bore 7' and a concentric counter bore 7", which bores are separated by limit shoulder 7B. The counter bore 7" extends from adjacent the eccentric fluid passage portion 1*b'* as better seen in FIGS. 2 and 2A and terminates at shoulder 7B. The ball is machined so that the outside diameter conforms to the seal seat ring 1*h'* and the inside radius of the retainer cap 8 which enables the ball and supported movable jetting nozzle extenders to rotate downward on retrieval of the ASJ tool.

Figure 2E:
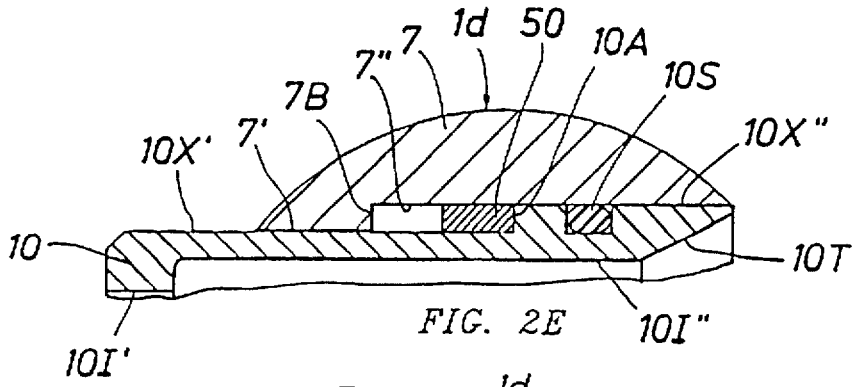
Figure 2F:
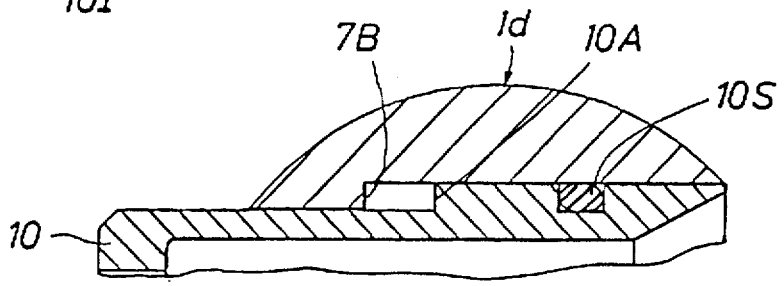

The inner and intermediate jetting nozzle extenders 14 and 12 are machined so as to have two outside diameters and two internal diameters. These diameters form shoulders which limit the outward travel of each jetting nozzle extender by abutting against the opposing shoulder, or by abutting against spacer rings 50 which are placed on the jetting nozzle extenders as shown in FIGS. 2H and 2E, respectively.

The inner jetting nozzle extender 10 has a small external diameter 10X' within said concentric bore 7' of ball 7 and has a large external diameter 10X" within the counter bore 7" at the end adjacent the eccentric fluid passage portion 1*b'*. Limit shoulder 10A separates the small and large external diameter of the inner jetting nozzle extender.

A nozzle seal 10S is located between the counter bore 7" of ball 7 and the large external diameter of the inner jetting nozzle extender 10 to maintain the respective components in slideable, sealing engagement with one another.

The void V in the form of the ASJ tool shown in the drawings and described, extends longitudinally and annularly between the limit shoulder 7B on counter bore surface 7" of member 1*d*, shown as a ball 7 in the FIG. 2 form, and the limit shoulder 10A on large external diameter 10X" of inner jetting nozzle extender 10, as seen in FIG. 2 of the drawings.

Limit spacers 50 of varying lengths may be positioned in the void V between the counter bore 7" of the ball and the small external diameter portion 10X' of the inner jetting nozzle extender 10 between the limit shoulder 7B of the ball 7 and limit shoulder 10A of the inner jetting nozzle extender to maintain relative separation or contact of the limit shoulders 7A and 10A during operation of the tool, or to control or limit the outward movement of the inner jetting nozzle extender relative to the ball.

Limit spacers 50 may be added to or removed from the ball/inner nozzle jetting extender assembly and/or the relative position of the ball shoulder 7B and/or the jetting nozzle extender 10A may be changed, or varied, as shown in FIGS. 2E–2H, to vary and or otherwise limit the slideable extent of the inner jetting nozzle extender, relative to the ball, in response to applied pressure during operation of the ASJ tool.

The inner jetting nozzle extender 10 has a small concentric internal diameter 10I' and a large concentric internal bore 10I" adjacent the eccentric fluid passage portion 1*b'* with the foregoing internal diameters separated by limit shoulder I0B.

Similarly, as shown in FIGS. 2–2A, an intermediate jetting nozzle extender 12 is positioned with its small external diameter 12X' within said concentric bore 10I' of the inner jetting nozzle extender 10 and has a large external diameter 12X" within its end adjacent the eccentric fluid passage portion 1*b'* with a limit shoulder 12A separating the small and large external diameters of the intermediate jetting nozzle extender. A nozzle seal 12S is located between the counter bore 10I" of the inner jetting nozzle extender 10 and the intermediate jetting nozzle extender 12 to maintain the respective components in slideable, sealing arrangement with one another.

The void V' extends longitudinally and annularly between the limit shoulder 12A on intermediate jetting nozzle extender 12, and the limit shoulder 10B on inner jetting nozzle extender 10, and the longitudinal surface 10I" on inner jetting nozzle extender 10 and the longitudinal surface 12X' on intermediate jetting nozzle extender 12 as seen in FIG. 2 of the drawings.

Limit spacers 50 may be positioned in the void V' between the counter bore 10I" of the inner jetting nozzle extender and the small external diameter 12X' of the intermediate jetting nozzle extender at a location between the limit shoulder 10B of the inner jetting nozzle extender and limit shoulder 12A of the intermediate jetting nozzle extender to maintain relative separation or limit spacers may be omitted which permits contact of limit shoulders 10B and 12A during operation of the ASJ tool.

Limit spacers 50 may be added to or removed from the inner/intermediate jetting nozzle extender assembly and or the relative position of the jetting nozzle extender limit shoulders 10B and 12A may be varied in order to vary or otherwise limit the slideable extent of the two respective jetting nozzle extenders in response to fluid pressure during operation of the ASJ tool.

The intermediate jetting nozzle extender 12 has a small concentric internal diameter 12I' and a large concentric internal bore diameter 12I" adjacent the eccentric fluid passage portion **1*b'* with said internal diameters 12I' and 12I" separated by limit shoulder 12B. As previously noted, a plurality of intermediate jetting nozzle extenders may be employed having a configuration of limit shoulders between each intermediate extender as above described with regard to jetting nozzle extender 12** to provide a void between each intermediate extender.

Within the single intermediate jetting nozzle extender 12, or the smallest of a series of intermediate jetting nozzle extenders, is an outer jetting nozzle extender 14 having a small external diameter 14X' slideably positioned within the concentric bore 12I' of of the intermediate jetting nozzle extender 12. The outer jetting nozzle extender 14 has a large external diameter 14X" adjacent the eccentric fluid passage portion **1*b'* with a limit shoulder 14A separating the small and large external diameters 14X' and 14X", respectively, of the outer jetting nozzle extender 14. A jetting nozzle seal 14S is located between the counter bore 12I" of the intermediate jetting nozzle extender 12 and the outer jetting nozzle extender 14 to maintain the jetting nozzle extenders 12 and 14** in slideable, sealing engagement with one another.

Where a plurality of intermediate jetting nozzle extenders are employed, they are similar in configuration to the single jetting nozzle extender above described and are arranged in a similar manner between the inner jetting nozzle extender 14 and outer jetting nozzle extender 10 so that there is a void or space formed and extending longitudinally and annularly between and within each of them, between and within the outer jetting nozzle extender 10 and the adjacent one of the plurality of intermediate jetting nozzle extenders and between and within the inner jetting nozzle extender 14 and the adjacent one of the plurality of jetting nozzle extenders.

The inner jetting nozzle extender 14 has a small concentric internal diameter 14I' and a large concentric internal bore diameter 14I" extending from adjacent the eccentric fluid passage portion **1*b'* with the internal diameters 14I' and 14I" separated by shoulder 14B**.

The void V" extends longitudinally and annularly between the shoulder 14A and surface 14X' on outer jetting nozzle extender 14, along with the shoulder 12B and surface 12I" on intermediate jetting nozzle extender 12, as seen in FIG. 2 of the drawings.

Limit spacers 50 may be positioned in the void V" between the counter bore 12I" of the intermediate jetting nozzle extender and the small external diameter 14X' of the outer jetting nozzle extender at a location between the shoulder 12B of the intermediate jetting nozzle extender and shoulder 14A of the inner jetting nozzle extender, in order to maintain relative separation or omitted as above stated to permit contact of the shoulders 12B and 14A during operation of the ASJ tool.

Limit spacers 50 may be added to or removed from the intermediate/inner jetting nozzle extender assembly and/or the relative position of the jetting nozzle extender shoulders 12B and 14A may be varied as illustrated in FIGS. 2D–2H, in order to vary and/or otherwise limit the slideable extent of the respective jetting nozzle extenders in response to applied fluid pressure during operation of the ASJ tool.

When there are no spacers or spacer rings 50 in the void V, or V', or V", the limit shoulders limit or stop relative longitudinal movement between the jetting nozzle extenders when they move into abutting relation as seen in FIG. 2H.

The void V extends, within and between each the member **1*d* and adjacent outer jetting nozzle extender 10. The void V' extends within and between each the outer jetting nozzle extender 10 and intermediate jetting nozzle extender 12. The void V" extends within and between the intermediate jetting nozzle extender 12 and the inner jetting nozzle extender 14 as seen in FIGS. 1,2, 2A, 2B and 8**.

A spherical ball shape with a concentric circular bore 7' and a concentric circular counter bore 7", as previously described herein, is the preferred form of the member **1*d***.

The form of the jetting nozzle extenders including the jetting nozzle extender is preferably tubular having preferably an annular outer surface, a small concentric internal diameter and a large concentric internal bore diameter as shown in FIGS. 1 and 2A.

Where the cooperating surfaces on the movable jetting nozzle extenders ME and the member **1*d* are not annular, the configuration of the voids V, V' and V" will be different, from that previously described herein and may approximate the inner surface configuration of the member 1*d* and the outer surface configuration of the movable jetting nozzle extenders and the inner surface of the member 1*d***.

Figure 2G:
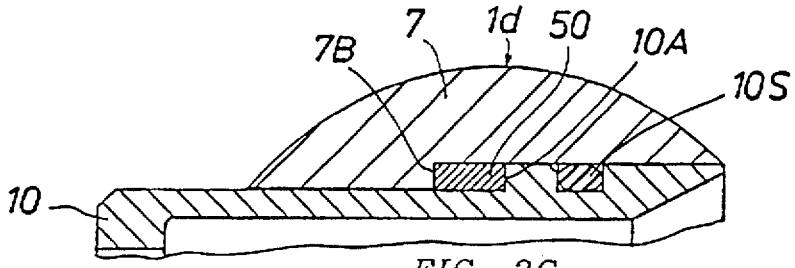
Figure 2H:
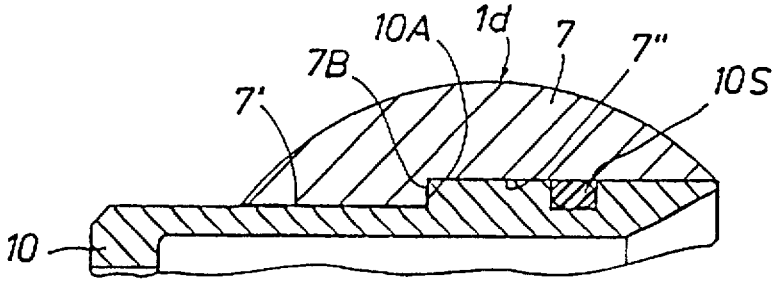

The spacers, or limit spacers 50 for the movable forms of jetting nozzle extenders above described and shown in FIGS. 2A, 2E and 2G are preferably in the form of rings of proper diameter for the particular jetting nozzle extender on which they are to be positioned before the jetting nozzle extenders are assembled as a set, or group and inserted in the member **1*d***.

The spacer rings 50 are formed of any suitable rigid material such as metal or a suitable plastic. They are of a suitable internal diameter to snugly and slideably engage with the movable extender on which they are to be positioned. They preferably should be of an inner diameter to enable them to be readily and easily positioned within and removed from the extender with which they are to be positioned. It is not necessary to fill the annular voids with spacer rings, but the spacer rings which are employed will sustain the compressive loading during operation of the tool.

The spacer rings 50 may have any desired longitudinal extent such as, by way of example only, ¼ inch, ½ inch or any other length desired, or a fraction thereof for the space between and within the adjacent extenders. Any combination of lengths of spacer rings may be placed in the space between the movable extenders to attain whatever relative movement, if any, is desired, to extend the movable jetting nozzle extenders from their telescoped position in the member 2.

In FIG. 2E, the limit shoulders 10A and 7B are spaced longitudinally with a single spacer ring 50 partially filling the void between the shoulders.

In FIG. 2F, the position of limit shoulder 10A is at a different location from that shown in FIG. 2E and there are no spacer rings 50 in the void between the limit shoulders 10A and 7B.

In FIG. 2G, limit shoulders 10A and shoulder 7B are each at a different location from that shown in FIG. 2F and a single spacer ring 50 fills the void extending within and between each the member **1*d*, shown in the form of a spherical ball 7, and jetting nozzle extender 10**.

In FIG. 2H the limit shoulders 10A and 7B are shown in abutting relation with no void therebetween.

The seal 10S between the member 1*d* and the inner extender 10 is represented in these views also.

FIGS. 2–2A and FIGS. 2E and 2H, as above noted, show various combinations, by way of example only and not by limitation, such as omission or inclusion of one or more limit spacers in the voids V, or V', or V", changing, or varying the longitudinal length of a void by changing the position of the shoulders on the concentric bores and concentric counter bores to vary the length of the bores/and or counter bores to vary the longitudinal extent between the shoulders.

The jetting nozzle extenders are generally formed of material, such as tool steel which is resistant to abrasive material or substance, but in some instances, such as the integral form of the jetting nozzle extenders, they are preferably formed of material which is more resistant to abrasive material, such as carbide. The jetting nozzle extender, the jetting nozzle and the orifice therein may be integrally formed as shown in FIGS. 2B–2D to provide a configuration more resistant to abrasive particle back wash thereon and increase the useful life of the components.

In addition to the internal chamfered surface 16T on the end of the orifice in the jetting nozzle 16 as seen in FIG. 2A, each inner, intermediate and outer jetting nozzle extender has an internal chamfered surface 14T, 12T and 10T at the inner or upstream end nearest the eccentric fluid passage portion 1*b'* to gradually, as opposed to abruptly, reduce the flow area therethrough and thus either minimize or eliminate turbulent flow of the abrasive slurry as it proceeds through the progressively smaller fluid passages in the ASJ tool as described herein.

Various arrangements of the jetting nozzle extenders, as shown in the drawings, by way of example in FIG. 2 with no spacers 50, a full set of spacers 50 in FIG. 2A, or shouldered arrangements by contacting the limit shoulders between the member 1*d*, and adjacent inner movable jetting nozzle extender 10, and/or shouldered arrangements between the other jetting nozzle extenders, as shown in FIG. 2H, or between the various jetting nozzle extenders so as to maintain the jetting jetting nozzle 16 in a constant or fixed position during running and operation of the ASJ tool.

FIG. 2A shows a full set of spacers 50 in the voids between member 1*d*, shown as a ball, and also between the jetting nozzle extenders in order to maintain a constant or fixed position of the jetting jetting nozzle 16 and to prevent extension of the jetting nozzle extenders during operation of the ASJ tool.

The jetting nozzle extenders may be shorter as shown in FIG. 2 in the initial run of the ASJ tool into the well bore which positions the movable jetting nozzle extenders to receive fluid from the passage means 1*b'* as soon as the ASJ tool is in a desired position in a location to be used, such as by way of example only, a well bore.

FIGS. 2B–2D show preferred forms of the ASJ tool which may be employed for removal or erosion of all or part of a casing or other types of structures by erosion and cutting. FIG. 6 shows the FIG. 2B form with two bodies B for cutting a casing section.

To remove a surface such as, by way of example only, a casing by erosion or cutting, the ASJ tool formed of one or more bodies B and their components as described herein are lowered by a workstring WS as illustrated in FIG. 6 to position the ASJ tool within the casing C at the desired elevation where the casing section is to be removed.

In the above mentioned surface removal, it is preferable to use the FIGS. 2B, 2C or 2D stationary form of integral jetting nozzle extender, jetting nozzle and orifice form of the ASJ tool, and it is preferable that the form used be of carbide or other tough material which is resistant to the back wash of the abrasive slurry and casing particles removed during the eroding of the casing section. It is also preferred that the stationary protrusion 24 of the jetting nozzle extender NE be positioned about ½ inch to two inches from the surface to be eroded which will indicate the diameter of body B and the length of the protrusion 24. When erosion of casing is being conducted, the protrusion 24 should be positioned as far away from the casing as possible to minimize the effect of back wash of the slurry jetting.

Where erosion of casing is to be conducted, the protrusion 24 should be of a length to extend outwardly relative to the body as much as possible to inhibit erosion of the body by backwash from the abrasive fluid.

Clean water is then discharged in the workstring which helps to seal off the seals and voids adjacent the components from the flow of the abrasive fluids. It also removes any debris in the workstring or arrangement which might plug jets while establishing pump and pressure rates. The volume of clean water should be somewhat in excess of the volume of the workstring and ASJ tool to assure that ample clean water has been provided to accomplish the desired results above described.

Where the casing C is to be removed for access to the adjacent formation to remove some of the formation to enhance production or to under-ream, it is preferable to use only one jetting nozzle extender or a plurality of jetting nozzle extenders at a single elevation preferably of the form shown in FIGS. 2C–2D is employed. It is preferred, by way of example only, that the jetting nozzle 16 be approximately about one inch from the internal surface of the casing when a section of the casing is to be jet blasted to remove the section.

The arrangement is lowered into the well bore on the workstring to place the body B so that the jetting nozzle thereon is at the lowermost end of the casing section to be cut.

The workstring WS is then rotated while raising it and the connected ASJ tool over the longitudinal extent of the casing to be cut or eroded while the abrasive slurry is discharged from the jetting nozzle 16 against the internal surface of the casing, wherein the upper end of the casing section removal represented is represented at CU and the lower end of casing section removal is shown at CL as seen in FIGS. 6–9 with the surrounding well bore surface exposed is represented at WBS.

Following removal of a casing section, the ASJ tool is removed from the well bore and a caliper log of the exposed surface WBS is obtained by a caliper logging instrument which is a tool well known in the art for determining the diameter and contour of a well bore surface, such as over the interval in which the casing has been removed.

This is a procedure well known to those skilled in the art. If it is desired to remove some of the exposed well bore surface WBS, it may be desirable to use the movable jetting nozzle extender form, represented as nozzle assembly NA of the ASJ tool shown in FIG. 7 which is substituted for the form shown in FIG. 6 and then adjusted by removal of limit spacer rings 50 to permit extension of the jetting nozzle extenders to position the jetting nozzle closer to the WBS by removing spacer rings 50 based upon information from the the caliper log to position the jetting nozzle at the desired spaced interval in relation to the WBS for removal of some of the well bore surface WBS by the abrasive slurry discharged through the tool.

In normal drilling operations a formation in a well bore may suffer skin damage by the drilling fluids so that the production from the well may be decreased from that it would normally have. Abrasive jetting of the formation near the well bore that is adjacent the casing in the well bore to remove the damaged surfaces may enhance the production from a well bore formation.

The ASJ tool may be used to enlarge or under-ream a well bore in the interval, herein referred to as under-reamed interval represented generally at UI in FIGS. 7–9 and 14 in which the casing C has been eroded or removed. Since the casing has been removed as above described in the casing erosion operation, an absence of support exists to absorb the back thrust against the ASJ tool due to the abrasive slurry exiting through the jet jetting nozzle 16.

To overcome this problem, it is recommended, by way of example only, that a number of bodies B, in multiples of two bodies and each body having one single jetting nozzle extender and a single jetting nozzle, or a set of plurality of jetting nozzle extenders and a jetting nozzle with the jetting nozzles in each body spaced, or offset, 180 degrees circumferentially or with the bodies B in multiples of three, and the jetting nozzles in the bodies spaced one hundred twenty degrees apart, or with the bodies in multiples of four and the jetting nozzles spaced ninety degrees apart be employed in the ASJ tool in order for sets of opposed jetting nozzles 16 to effect a counter balancing or reverse force acting against the back thrust developed as the slurry fluid exits each jet jetting nozzle 16 under pressure. Other combinations may be employed.

After completion of the first under-reaming run of the ASJ tool through the under-reamed interval UI, pumping of the slurry is discontinued and the workstring is raised to remove the ASJ tool from the well bore. If, during any operation any jetting nozzle extender may be extended beyond the internal diameter of the casing C or beyond the diameter of the earth formation as the workstring and ASJ tool is raised, the jetting nozzle extenders are moved into contact with the casing end, represented at CU, or earth formation thereabove, causing the member 1*d*, such as a ball 7, by way of example only, which contain the movable jetting nozzle extenders to rotate and move the extended jetting nozzle extenders through the opening in the horse shoe shaped retaining cap 8, to position the extended jetting nozzle extenders within the recess 1*e* in the body B which enable the ASJ tool to be retrieved.

The caliper log is again run, to determine the extension required of the jetting nozzle extenders to position them operationally as desired to complete the next erosion step in an under-reamed section UI, and spacers are removed to increase the extent, or length of the voids between the jetting nozzle extenders as necessary to permit further extension of the jetting nozzle extenders within operational distance of the newly eroded under-reamed surface in the interval UI to remove further well bore surface WBS within the well bore and operated as previously described.

Figures 14, 15, 16, 17:
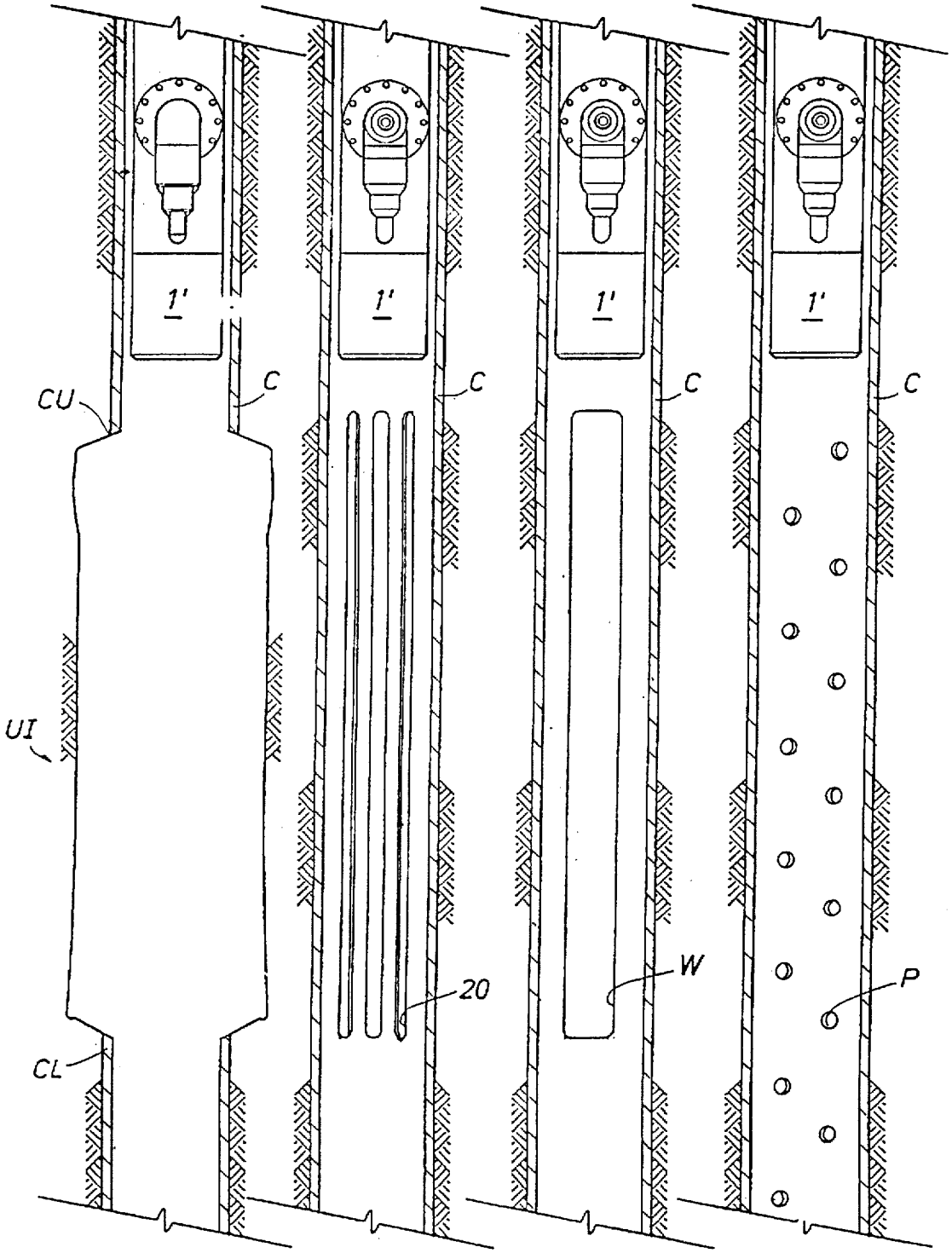

The foregoing operation is repeated until the desired extent of under-reamed WBS has been attained as indicated by the caliper log, and as illustrated in FIGS. 9 and 14.

After the removal of the casing section, or after removal of any of the WBS or in any other operation with the ASJ tool, it is preferred that clean water be pumped down the workstring in a volume slightly larger than the volume of the workstring and ASJ tool to flush any abrasive particles or debris remaining in the ASJ tool through the jetting nozzle 16. It may be desirable in some instances to reverse circulate in which event the lower sub will be provided with the one way valve arrangement of FIG. 5 and clean water circulated down through the well bore and through the annulus between the well bore and the workstring and returned to the surface through the ASJ tool and the workstring.

A surface, such as by way of example only casing C, may be slotted longitudinally a desired extent as illustrated by slots 20 in FIG. 15 by positioning the ASJ tool at the desired elevation within the casing and the ASJ tool raised by the workstring while the abrasive slurry is discharged against the internal surface of the casing C.

If the ASJ tool has a plurality of bodies, then the initial make-up of the bodies relative to each other may be adjusted by adjusting the thread make-up gage or shoulder point between each body so as to direct each jetting jetting nozzle 16 in the desired azimuth or direction to effect counter balancing of the slurry fluid exiting from the jetting nozzles while forming the slots.

The ASJ tool is then positioned within the location where the jetting operation is to be performed in the casing and the abrasive slurry is discharged in a plurality of desired azimuths or directions from each body in the desired directions and radial spacings internally of the casing.

If only one body is used, the workstring is raised while the abrasive slurry is discharged to form one slot, and the flow of abrasive slurry stopped, then the workstring rotated to position the ASJ tool to form the next circumferentially spaced slot and then lowered, or it is lowered to the elevation of the first slot, rotated the desired number of degrees to obtain the desired radial slot spacing and the workstring raised while the slurry is discharged to form the slot. The procedure is repeated until the desired number of slots 20 is formed as illustrated in FIG. 15.

A window W as illustrated in FIG. 16 may be cut in the casing C by positioning the ASJ tool in the casing with the jet nozzle at the lower end of the window to be eroded and raising the ASJ tool the desired window length while the abrasive slurry is jetted against the internal surface of the casing. The pumping of the abrasive slurry is stopped and the ASJ tool is lowered to the bottom of the window and the workstring is rotated while the abrasive slurry is jetted to effect or cut the desired window width. The prior operation of pumping the abrasive slurry while raising the ASJ tool is repeated and then rotated while lowering the ASJ tool to the bottom of the window and then rotating it and raising it and then lowering it until the desired width of window has been formed.

Perforations P may be formed in the casing C as shown in FIG. 17 by positioning one body B, or plural bodies B with either the integral form or movable form of jetting nozzle extenders in the casing C and maintaining it in such position where the perforations are to be formed in the casing C while providing abrasive fluid to to the ASJ tool to form whatever selected pattern of perforations P may be desired.

When the movable jetting nozzle extender form is used in the ASJ tool to permit extending and movement of the jetting nozzle extenders during operation of the ASJ tool within the well or other remote location, frangible members, such as shear pins 23, 23' and 23", may be installed as shown respectively in FIG. 2 between the cap 8 and the inner extender 10, between the inner extender 10 and the intermediate extender 12 and between the intermediate extender 12 and outer extender 14, by way of example only, to prevent premature movement of the movable extenders in body B as the ASJ tool is lowered into position which shear pins, or frangible members, will break in response to increased pressure of the abrasive slurry being pumped through the jetting nozzle extenders and jetting nozzle 16, causing the jetting nozzle extenders to extend in response to fluid pressure in the ASJ tool and move the inner jetting nozzle extender 14 and jetting nozzle 16 therein outwardly from body B to the extent desired and determined by the position and number of limit spacers 50 positioned in the voids V, V', and V". The shear pins retain the movable jetting nozzle extenders retracted until the ASJ tool is positioned at the desired location. The sequence of breaking of frangible members such as shear pins, by way of example only, is immaterial since the only purpose of the shear pins is to maintain the movable extenders retracted.

In the above described ASJ tool operations, erosive debris may collect within the well bore which may require periodic operations employing a workstring and other tools well known in the art to bail, circulate or otherwise remove such debris from the well bore.

While specific devices are used to rotate and raise the workstring during the operations described herein, relative movements of the ASJ tool are not part of the invention. Such devices are well known in the art and are readily available. However, particular attention should be paid with regard to the selection of the devices to assist in proper use and functioning of the invention, such as by way of the examples described below.

Slow and steady rotational capability and torque control such as that deliverable with a power swivel; slow and controlled lifting capability such as that deliverable by a hydraulic compensator unit; pressure sensing devices to accurately sense the jetting nozzle pressure and other physical variables to enable comprehensive selection of rotational and longitudinal movement rates during operation of the ASJ tool; and computer hardware and software capabilities to rapidly determine and control the comprehensive selections stated above The outwardly extending taper or chamfer as illustrated in FIGS. 2 and 2A on the inner ends of the individual movable jetting nozzle extenders provide as much opening as possible to receive fluid from the eccentric passage portion **1*b*' to assist in reducing the flow volume gradually to the jetting nozzle 16 to decrease, if not eliminate turbulence as the abrasive fluid flows from the passage means 1*b* into the outer jetting nozzle extender in which the jetting nozzle 16** is positioned.

By way of example only, one suitable size of the individual movable jetting nozzle extenders in the one form as shown in the drawings may be be as follows, expressed in inches and fractions thereof:

inner jetting nozzle movable extender;
- length; 5 and ¼
- small internal diameter; 1.595
- large internal diameter; 1.876
- small outer diameter; 2.183
- large outer diameter 2.370 intermediate jetting nozzle extender;
- length; 5 and 7/16
- small internal diameter; 1.050
- large internal diameter; 1.313
- small outer diameter; 1.590
- large outer diameter; 1.870 outer extender 29;
- length; 5 and ½
- internal diameter of passage **29*h***; 11/16 inch
- small outer diameter; 1.045 inches
- large outer diameter; 1.307 inches
- small outer diameter; 1.045 inches
- large outer diameter; 1.307 inches
- nozzle orifice size; 3/16 inch The above dimensions can be varied for various applications. For example, if it is desired to jet blast a well bore casing or well bore surface where there is a tubing of smaller diameter extending into the well bore and a larger diameter casing, the body B and the movable jetting nozzle assembly or the integral form may be dimensioned to permit the ASJ tool to pass through the tubing and then moving the jetting nozzle extenders outwardly beyond the diameter of the tubing to treat a surface below the tubing without first removing the tubing from the well bore, which removal can be a costly operation.

In some instances it may be desirable to coat the outer end surfaces of the movable jetting nozzle extenders with a protective abrasive coating to resist damage due to back wash from the abrasive jetting fluid and particles removed from the surface being treated.

The seal means in seal seat **1*h*' provided between the juncture of the surfaces forming the first or inner end 2" of the hole 2 in each body B and outer surface of member 1*d* at the inner end 2" of hole 2 prevent or inhibit fluid communication between the passage means 1*b* and the hole 2 in each body B. As better seen in FIG. 2**, seal means are provided between the movable extenders.

One manner of forming the bodies B employed in the present invention is to form the generally longitudinally extending passage means **1*b* by plural passages represented by the partial circular dash-line 1C'** and if they are in the form shown in the drawings, this is done by way of example, by drilling the passage means in each body to overlap in their longitudinal extent to provide as large a passage as possible within the body B to reduce flow turbulence and inhibit damage to the components which are exposed to the fluid with the abrasives therein.

Where the seal ring is annular, each body B is milled to form an annular seat therein adjacent the internal body wall next to the longitudinal passage means to receive the seal means.

The hole 2 is milled or formed in the body B to receive the member **1*d* in the hole 2** in each body B.

Each body B external surface is formed in any suitable manner to provide an external surface configuration which conforms with what ever configuration the internal surface of the cap 8 may have to receive the cap 8. The cap 8 may be removably connected with the body B in any suitable manner, such as, by way of example only, by bolts, or it may be threadedly connected with the body B or cam locked on the body B.

If bolts are are to be used, the body B is then drilled and tapped for receiving the bolts 8B to releasable secure the cap 8 to the body B to position and maintain the member **1*d* in position on the body B. The inner surface of the cap is configured to support the member 1*d* in some forms of the ASJ tool so that the member 1*d* can at least partially rotate, or oscillate within the hole 2** of the body B.

In one form of the arrangement as better seen in FIG. 1, the top or upper end 35 of each body B is internally threaded at 34 to receive the upper sub 1 and the upper sub is threaded at 37 at its upper end to connect with a workstring.

The bottom or lower end 35' of each body is milled or bored as shown in the drawings, and is externally threaded at 34" to receive a lower or bottom sub 1' or the upper end of a body B.

The lower body B shown in FIG. 1 may be eliminated so that there is only one body B and in which event the concentric passage portion **1*b*"** of the upper body B would not extend through the bottom end of the body B as it does and as shown in FIG. 1, and body B would have a lower sub or bushing 1' with a closed end 1*a* as shown on the lower end of the the lower body B of FIG. 1, or it may have the one way valve means 39 shown in FIG. 5.

The present invention may be assembled in any any suitable manner, and the assembly is described with regard to the embodiment of the invention shown in the drawings. It is understood that the present form, as well as other forms and embodiments of the invention may employ different assembly steps.

After the bodies B have been machined, the seal seat ring with the seals thereon is inserted in and seated at the first end 2' of the the hole 2 of each body adjacent the overlapping passages 1C'. The seals 10S, 12S and 14S are positioned in each groove 38' of each inner, intermediate and outer jetting nozzle extender as as shown in FIG. 2 of the drawings and suitable seal means such as an o-ring is positioned in the annular grooves 38 on the external surface adjacent the lower end between each connected body B and between the top body B and the upper or top sub or bushing 1 and between the bottom sub or bushing and lowermost sub or bushing 1' as illustrated in FIG. 1 of the drawings.

When the multiple movable jetting nozzle extender form of the ASJ tool is employed, spacers 50 are inserted or omitted from the voids V, V' or V" as desired to accomplish the positioning of the movable jetting nozzle extenders and the jetting nozzle extender and jetting nozzle 16 relative to the surface to be treated.

If a removable jetting nozzle orifice is used, it is fitted with seal 16S and then is positioned in the bore of the inner jetting nozzle extender 14 and the snap or lock ring 16A positioned in the radial groove 14G.

The jetting nozzle extenders are then assembled by placing seals in the annular grooves 38' between each of the movable extenders as shown in FIG. 2A, and then telescopically connecting them together one over the other so that when an extender assembly EA is completed, the inner jetting nozzle extender 14 which includes the jetting nozzle 16 is surrounded by a single intermediate jetting nozzle extender 12, or multiple intermediate jetting nozzle extenders 12, one over the other and then the outer jetting nozzle extender 10 to form the assembly, or group with at least one group, or nozzle assembly NA, formed for each body B to be used in the ASJ tool. There may be multiple assemblies or multiple groups of jetting nozzle extenders in a body of suitable size.

One assembly, or group, of movable jetting nozzle extenders ME is then positioned in the opening 1*d'* of each member 1*d* and the member 1*d* is then inserted in the hole 2 of the member 1*d*.

The integral jetting nozzle extender assembly NE of FIGS. 2B and 2D, each with a protrusion 24 extending exteriorly of body B are formed and then in the FIGS. 2B and 2D forms a seal 21D is placed in groove 21 D'.

The FIG. 2A form is inserted in the opening of member 1*d*, while in the FIGS. 2C and 2D forms the integral extender assembly NE including member 1*d* is positioned in the hole 2 of body B.

The non-movable, integral extender assembly NE of FIG. 2C includes a member 1*d*, the jetting nozzle extender 14, the protrusion 24, the jetting nozzle 16 and its orifice which may be integrally formed with jetting nozzle 16 or removably positioned therein as seen in FIG. 10A.

The seat ring 1*h'* is positioned in hole 2 of body B, and the assembled FIG. 2C form is inserted in hole 2 of the body B and seated on seat ring 1*h'* and cap 8 is secured to the body B by bolts 8B or other suitable means.

The non-movable, integral extender assembly NE of FIG. 2D includes member 1*d*, the protrusion 24, the jetting nozzle extender 14 with jetting nozzle 16 and its orifice O, which orifice O may be integrally formed with jetting nozzle 16 or jetting nozzle 16 may be removably positioned therein as described.

The assembled FIGS. 2C and 2D form is inserted in hole 2 of the body B and the cap is removably secured to the body B by bolts 8B or other suitable means.

The FIG. 2B integral jetting nozzle extender assembly NE includes the jetting nozzle extender 14, the protrusion 24, the jetting nozzle 16 and its orifice O which may be integrally formed with the jetting nozzle 16 as shown in FIG. 6 or the jetting nozzle 16 may be removably positioned therein as seen in FIG. 10A. It is then positioned in the opening 1*d'* of member 1*d* and then inserted in hole 2 of body B.

A seal 21D is placed in the annular groove 21D' on the integral assembly NE, and the assembly NE is inserted in opening id' of member id and shoulder 21' on the 2B integral extender abuts shoulder 7B extending between bore 7' of ball member 1*d* and counter bore 7" as seen in FIGS. 2B and 6. The ball 7 is seated on seat ring 1*h'* as shown in the drawings. Cap 8 is then secured to the body B by bolts 8B or other suitable means.

In the initial run of the ASJ tool, when an assembly or group of movable jetting nozzle extenders ME is positioned within the opening 1*d'* of the member 1*d*, it is generally preferred that the set or group of jetting nozzle extenders be shorter, as seen in FIG. 2, or some of the spacer rings 50 be removed as shown in FIG. 1 so longitudinal passage means 1*b* is full open at its upper end adjacent the lower end of upper sub or bushing 1 in the initial run of the ASJ tool for supplying clean water to the ASJ tool components. Also, preferably none of the movable jetting nozzle extenders extend beyond the outer end of the opening 8" in cap 8 as the ASJ is lowered into position.

It may be preferred in the inital run that the spacer rings 50, as seen in FIGS. 1 and 2A be present in sufficient quantity in the voids V, V' and V" to prevent movement of the movable jetting nozzle extenders beyond the exterior of the body B, including the cap 8.

The assembled arrangement is then lowered into the well bore on a workstring to perform the desired operation.

The passage means 1*b* extends longitudinally of each body B, and where plural bodies B are connected together, as shown in the drawings, the overlapping configuration 1C' extends longitudinally at least beyond the location of the movable jetting nozzle extenders in the opening 1*e* of the member 1*d* in the lowermost body B of the connected bodies.

The arrangement may comprise any desired number of bodies B that may be connected together in any suitable manner, and are shown as threadedly connected together in the drawings.

The density of the abrasive fluid slurry may vary, and one suitable density which may be employed is one pound of sand, ceramics, garnet, or other media or any other abrasive substance well known to those skilled in the art per gallon of clean water is added, preferably while rotating the workstring. Jells and or polymers may be added as required to reduce friction as well as aiding in suspending the media A jet hopper or blender, by way of example only, may be used at the earth's surface to to obtain the desired density and by way of example only, a suitable means of measurement, such as a densometer may be utilized to determine the concentration. The concentration of abrasive media is dependent upon the operation to be performed. By way of example only, if the operation is in a well bore the concentration will depend upon various factors including the well bore formation, jet nozzle configuration, and/or casing to be cut or eroded.

The rate of rotation of the workstring and the jetting arrangement, and the rate of longitudinal movement, up and/or down will depend on the density of the surface, or target. A hydraulic compensator may be employed to control the longitudianl movement of the workstring and ASJ. The compensator may be computer controlled and programmed in a manner well known to those skilled in the art and depending on the well conditions and the orifice size in the jetting nozzle and is controlled through computer interface in a manner well known in the art.

By way of example only, the rate of longitudinal movement of the jetting arrangement to cut or erode casing may be be one half inch per minute while the rate of movement to cut formation may be one to two inches per minute. The rate of rotation, by way of example only, while cutting or eroding casing may be two to three revolutions per minute and the rate of rotation while cutting formation may be four to six revolutions per minute.

By way of example only, the abrasive concentration for cutting casing may be one to two pounds of abrasive per gallon of water, and the abrasive concentration for cutting formation may be zero to two pounds of abrasive per gallon of water. The density of the target will determine the rate of movement and the abrasive concentration. For example, a surface, or formation with the density of concrete will cut slower than that with the density of salt and normally steel casing will cut slower than formation.

The ASJ may be dimensioned so that it may be run through tubing in a well bore and the movable jetting nozzle extenders then extended to perform whatever operations in the well bore, including a well bore with casing are desired.

The above rates of movement, rotation, and abrasive concentration may vary. The density of the abrasive slurry may be measured by any suitable means, as by way of example only, a densometer of any well known type before and/or after any of the slurry is discharged into the workstring.

The ASJ is made up on a workstring, which workstring may be tubing, drill pipe or coiled tubing and then run to the desired depth, or location where it is to be employed. The hydraulic servo compensator is made up at the earth's surface with a power swivel below, but is not used with coiled tubing.

The safety valve below the swivel is closed and pump lines are tested. The workstring and ASJ are filled with clean water and pump and pressure rates are tested in any suitable manner well known to those skilled in the art.

The workstring is rotated while mixing and discharging abrasive fluid into the workstring to achieve the desired density and then the workstring is manipulated to carry out what ever jetting operation is to be accomplished. Various caliper logs are taken depending upon the operation involved After any jetting operation is completed clean water is again circulated through the arrangement and discharged through the jetting jetting nozzle 16 to flush out abrasive slurry remaining in the well string and jetting arrangement.

The foregoing description is illustrative and various changes may be made without departing from the spirit of the invention defined in the claims.

What is claimed is:

1. A downhole jetting tool positionable within a well bore from a workstring for abrasive fluid jetting a surface, the jetting tool comprising:

a generally cylindrical tool body including an upper end adapted for interconnection with the workstring, the tool body having a central body axis;

the tool body including at least one axially extending passageway in fluid communication with the workstring and at least one laterally extending body hole extending radially from the at least one axially extending passageway to an exterior surface of the tool body, the at least one axially extending passageway having a passageway axis offset from the central body axis;

a retainer cap secured to the tool body and having at least one cap hole in communication with the at least one laterally extending body hole;

a jetting nozzle positioned within the at least one laterally extending body hole and corresponding cap hole for jetting fluid from the at least one axially extending body passageway onto the surface;

the jetting nozzle being radially movable with respect to the tool body from a radially inward position to a radially outward position;

a jetting nozzle support for pivotally supporting the jetting nozzle on the tool body such that an axis of the jetting nozzle may be pivotally adjusted within the at least one laterally extending body hole.

2. The downhole jetting tool as defined in claim 1, wherein:

the at least one axially extending body passageway includes a plurality of axially extending body passageways each having a passageway axis offset from the central body axis; and a plurality of jetting nozzles each positioned within a respective laterally extending body hole and corresponding cap hole for jetting fluid from a respective one of the axially extending body passageways.

3. The downhole jetting tool as defined in claim 1, wherein the at least one axially extending body passageway comprises:

an upper axially extending body passageway having an upper passageway axis offset from the central body axis; and a lower axially extending body passageway having a lower passageway axis offset from both the central body axis and the upper passageway axis.

4. The downhole jetting tool as defined in claim 3, further comprising:

an intermediate passageway fluidly interconnecting the upper axially extending body passageway and the lower extending body passageway, the intermediate passageway having an axis substantially concentric with the central body axis.

5. The downhole jetting tool as defined in claim 3, where in the upper axially extending body passageway and the lower axially extending body passageway are spaced on opposite sides of the tool body with respect to the tool body axis.

6. The downhole jetting tool as defined in claim 1, further comprising:

a plurality of bolts for removably securing the retainer cap to the tool body.

7. The downhole jetting tool as defined in claim 1, wherein the at least one axially extending body passageway defines an annular seat for receiving a closure member for at least substantially shutting off fluid flow from the tool body.

8. The downhole jetting tool as defined in claim 7, wherein the closure member may be raised off the annular seat by reverse fluid circulation through the tool body.

9. The downhole jetting tool as defined in claim 1, further comprising:

a replaceable spacer for selectively limiting radially outward movement of the jetting nozzle with respect to the tool body.

10. The downhole jetting tool as defined in claim 1, wherein the spacer is an annular ring member.

11. The downhole jetting tool as defined in claim 1, further comprising:

first and second jetting nozzles each positioned within a respective first and second laterally extending body hole and a corresponding first and second cap hole, each of the first and second jetting nozzles being circumferentially spaced approximately 180° apart on the tool body about the central body axis.

12. The downhole jetting tool as defined in claim 1, further comprising:

first, second, and third jetting nozzles each positioned within a respective first, second, and third laterally extending body hole and a corresponding first, second, and third cap hole, each of the first, second, and third jetting nozzles being circumferentially spaced approximately 120° apart on the tool body about the central body axis.

13. The downhole jetting tool as defined in claim 1, further comprising:

first, second, third, and fourth jetting nozzles each positioned within a respective first, second, third, and fourth laterally extending body hole and a corresponding first, second, third, and fourth cap hole, each of the first, second, third, and fourth jetting nozzles being circumferentially spaced approximately 90° apart on the tool body about the central body axis.

14. The downhole jetting tool as defined in claim 1, further comprising:

a frangible member for engaging the jetting nozzle to prevent premature radial movement of the jetting nozzle to the radially outward position.

15. The downhole jetting tool as defined in claim 14, wherein the frangible member is a shear pin selectively sized for shearing in response to fluid pressure in the at least one axially extending body passageway.

16. The downhole jetting tool as defined in claim 1, wherein the jetting nozzle includes one or more jetting nozzle extenders each having an upstream end with a frustoconical upstream surface for minimizing turbulent flow of fluid from the at least one axially extending body passageway through the jetting nozzle.

17. The downhole jetting tool as defined in claim 1, wherein the jetting nozzle includes a plurality of jetting nozzle extenders telescopingly arranged within the at least one laterally extending body hole and corresponding cap hole.

18. The downhole jetting tool as defined in claim 17, wherein each of the plurality of jetting nozzle extenders includes an upstream end having a frustoconical upstream surface for minimizing turbulent flow through the jetting nozzle.

19. The downhole jetting tool as defined in claim 17, further comprising:

a plurality of selectively sized spacers each for limiting radial movement of a corresponding one of the plurality of jetting nozzle extenders.

20. The downhole jetting tool as defined in claim 1, wherein the at least one laterally extending body hole includes a cavity for receiving the jetting nozzle when the axis of the jetting nozzle is substantially inclined relative to an axis normal to the tool body axis, such that the jetting nozzle may be pivoted into the cavity for retrieving the downhole jetting tool.

21. The downhole jetting tool as defined in claim 1, wherein the jetting nozzle support is a ball member pivotally movable within the tool body.

22. The downhole jetting tool as defined in claim 21, further comprising:

a seal for maintaining sealing engagement between the tool body and an outer surface of the ball member during pivotable movement of the ball member with respect to the tool body.

23. The downhole jetting tool as defined in claim 1, wherein the jetting nozzle is within said tool body when in the radially inward position such that said central body axis passes through the jetting nozzle.

24. A downhole jetting tool for suspending within a well bore from a workstring for abrasive fluid jetting a surface, the jetting tool comprising:

an elongate tool body including an upper end for interconnection with the workstring, the elongate tool body having a central body axis;

the tool body including at least one axially extending passageway in fluid communication with the workstring and at least one laterally extending body hole extending radially from the axially extending passageway to an exterior surface of the tool body;

at least one radially movable jetting nozzle positioned within the at least one laterally extending body hole for jetting fluid from the at least one axially extending body passageway onto the surface, the at least one jetting nozzle having a jet nozzle discharge aperture; and the at least one jetting nozzle being radially movable with respect to the tool body within the at least one body hole from a radially inward position wherein the at least one jetting nozzle is at least substantially housed within the tool body to a radially outward position wherein the jet nozzle discharge aperture is at least substantially exterior of the tool body.

25. The downhole jetting tool as defined in claim 24, wherein the at least one jetting nozzle when in the radially inward position is intersected by the central body axis.

26. The downhole jetting tool as defined in claim 24, wherein the at least one jetting nozzle has a radially exterior surface positioned radially inward of an exterior surface of the tool body when the at least one jetting nozzle is in the radially inward position.

27. The downhole jetting tool as defined in claim 24, wherein the at least one jetting nozzle includes a plurality of jetting nozzle extenders telescopingly arranged within the at least one laterally extending body hole.

28. The downhole jetting tool as defined in claim 27, wherein each of the plurality of jetting nozzle extenders includes an upstream end having a frustoconical upstream surface for minimizing turbulent flow through the jetting nozzle.

29. The downhole jetting tool as defined in claim 24, further comprising:

a replaceable spacer for selectively limiting radially outward movement of the at least one jetting nozzle with respect to the tool body.

30. The downhole jetting tool as defined in claim 29, wherein the spacer is an annular ring member.

31. The downhole jetting tool as defined in claim 24, further comprising:

a retainer cap secured to the tool body and having at least one cap hole in communication with the at least one body hole; and a plurality of securing members for securing the retainer cap to the tool body.

32. The downhole jetting tool as defined in claim 24, wherein the at least one axially extending body passageway defines an annular seat for receiving a closure member for at least substantially shutting off fluid flow from the tool body.

33. The downhole jetting tool as defined in claim 24, further comprising:

the at least one jetting nozzle comprises a plurality of jetting nozzles each positioned within a respective laterally extending body hole, each of the plurality of jetting nozzles being circumferentially spaced approximately equidistant apart on the tool body about the central body axis.

34. The downhole jetting tool as defined in claim 24, further comprising:

at least one frangible member for engaging the at least one jetting nozzle to prevent premature radial movement of the at least one jetting nozzle to the radially outward position.

35. The downhole jetting tool as defined in claim 34, wherein the at least one frangible member is a shear pin selectively sized for shearing in response to fluid pressure in the at least one axially extending body passageway.

36. The downhole tool as defined in claim 24, further comprising:

at least one jetting nozzle support for pivotally supporting a respective one of the at least one jetting nozzles on the tool body such that an axis of each jetting nozzle may be pivotally adjusted within the at least one laterally extending body hole.

37. The downhole jetting tool as defined in claim 36, wherein the at least one jetting nozzle support is a ball member pivotally movable within the tool body.

38. The downhole jetting tool as defined in claim 37, further comprising:

a seal for maintaining sealing engagement between the tool body and an outer surface of the ball member during pivotable movement of the ball member with respect to the tool body.

39. The downhole jetting tool as defined in claim 36, wherein the tool body includes at least one cavity for receiving a respective jetting nozzle when the axis of the jetting nozzle is substantially inclined relative to an axis normal to the tool body axis, such that the jetting nozzle may be pivoted into the cavity for retrieving the downhole jetting tool.

40. The downhole jetting tool as defined in claim 24, wherein:

the at least one axially extending body passageway includes a plurality of axially extending body passageways each having a passageway axis offset from the central body axis; and each of the at least one jetting nozzles is positioned within a respective laterally extending body hole for jetting fluid from a respective one of the at least one axially extending body passageways.

41. The downhole jetting tool as defined in claim 24, wherein the at least one axially extending body passageway comprises:

an upper axially extending body passageway having an upper passageway axis offset from the central body axis; and a lower axially extending body passageway having a lower passageway axis offset from both the central body axis and the upper passageway axis.

42. A downhole jetting tool for positioning within a well bore from a workstring for abrasive fluid jetting a surface, the jetting tool comprising:

a tool body including an upper end for interconnection with the workstring, the tool body having a central body axis;

the tool body including an extending passageway in fluid communication with the workstring and a laterally extending body hole extending radially from the axially extending passageway to an exterior surface of the tool body;

a jetting nozzle positioned within the laterally extending body hole for jetting fluid from the axially extending body passageway onto the surface, the jetting nozzle having a jetting nozzle axis;

a jetting nozzle support for pivotally supporting the jetting nozzle on the tool body such that the axis of the jetting nozzle may be pivoted within the laterally extending body hole;

the jetting nozzle has a radially exterior surface positioned radially inward of or radially at an exterior surface of the tool body when the jetting nozzle is in the radially inward position.

43. The downhole jetting tool as defined in claim 42, wherein the jetting nozzle support is a ball member pivotally movable within the tool body.

44. The downhole jetting tool as defined in claim 43 further comprising:

a seal for maintaining sealing engagement between the tool body and an outer surface of the ball member during pivotable movement of the ball member with respect to the tool body.

45. The downhole jetting tool as defined in claim 42, wherein the tool body includes a cavity for receiving the jetting nozzle when the jetting nozzle axis is substantially inclined relative to an axis normal to the tool body axis, such that the jetting nozzle may be pivoted into the cavity for retrieving the downhole jetting tool.

46. The downhole jetting nozzle as defined in claim 42, wherein the jetting nozzle is radially movable with respect to the jetting nozzle support from a radially inward position to a radially outward position.

47. The downhole jetting nozzle as defined claim 46, wherein the jetting nozzle when in the radially inward position is intersected by the central body axis.

48. The downhole jetting tool as defined in claim 46, further comprising:

a frangible member for engaging the jetting nozzle to prevent premature radial movement of the jetting nozzle to the radially outward position.

49. The downhole jetting tool as defined in claim 46, wherein the jetting nozzle includes a plurality of jetting nozzle extenders telescopingly arranged within the laterally extending body hole.

50. The downhole jetting tool as defined in claim 49, wherein each of the plurality of jetting nozzle extenders includes an upstream end having a frustoconical upstream surface for minimizing turbulent flow through the jetting nozzle.

51. The downhole jetting tool as defined in claim 49, further comprising:

a plurality of replaceable spacers each for selectively limiting radially outward movement of a respective jetting nozzle extender with respect to the tool body.

52. The downhole jetting tool as defined in claim 46, further comprising:

a selectively sized spacer for limiting radial outward movement of the jetting nozzle.

53. The downhole jetting tool as defined in claim 42, further comprising:

a retainer cap secured to the tool body and having a retainer cap hole in communication with the body hole; and a plurality of securing members for removably securing the retainer cap to the tool body.

54. The downhole jetting tool as defined in claim 42, wherein the axially extending body passageway defines an annular seat for receiving a closure member for at least substantially shutting off fluid flow from the tool body.

55. The downhole jetting tool as defined in claim 42, further comprising:

a plurality of jetting nozzles each positioned within a respective laterally extending body hole, each of the plurality of jetting nozzles being circumferentially spaced approximately equidistant apart on the tool body about the central body axis.

56. The downhole jetting tool as defined in claim 42 wherein:

the axially extending body passageway includes a passageway axis offset from the central body axis.

57. The downhole jetting tool as defined in claim 42, wherein the axially extending body passageway comprises:

an upper axially extending body passageway having an upper passageway axis offset from the central body axis; and a lower axially extending body passageway having a lower passageway axis offset from both the central body axis and the upper passageway axis.

58. The downhole jetting tool as defined in claim 57, further comprising:

an intermediate passageway fluidly interconnecting the upper axially extending body passageway and the lower extending body passageway, the intermediate passageway having an axis substantially concentric with the central body axis.

59. The downhole jetting tool as defined in claim 57, wherein the upper axially extending body passageway and the lower axially extending body passageway are spaced on opposite sides of the tool body with respect to the tool body axis.

60. A downhole jetting tool for suspending within a well bore from a workstring for abrasive fluid jetting a surface, the jetting tool comprising:

an elongate tool body including an upper end for interconnection with the workstring, the elongate tool body having a central body axis;

the tool body including an axially extending passageway in fluid communication with the workstring and a laterally extending body hole extending radially from the axially extending passageway to an exterior surface of the tool body;

a radially movable jetting nozzle positioned within the laterally extending body hole for jetting fluid from the axially extending body passageway onto the surface, the radially movable jetting nozzle having a jet discharge aperture for jetting fluid from the jetting nozzle onto the surface;

the jetting nozzle being radially movable with respect to the tool body and within the body hole from a radially inward position wherein the jetting nozzle is at least substantially housed within the tool body to a radially outward position wherein the jet discharge aperture is at least substantially exterior of the tool body; and a replaceable spacer for selectively limiting radially outward movement of the jetting nozzle with respect to the tool body when the jetting nozzle is in the radially outward position, such that the jet discharge aperture is selectively radially spaced from the exterior of the tool body and adjacent the surface.

61. The downhole jetting tool as defined in claim 60, wherein the spacer is annular ring member.

62. The downhole jetting tool as defined in claim 60, wherein the jetting nozzle when in the radially inward position is intersected by the central body axis.

63. The downhole jetting tool as defined in claim 60, wherein the jetting nozzle has a radially exterior surface positioned radially inward of an exterior surface of the tool body when the jetting nozzle is in the radially inward position.

64. The downhole jetting tool as defined in claim 60, wherein the jetting nozzle includes a plurality of jetting nozzle extenders telescopingly arranged within the laterally extending body hole.

65. The downhole jetting tool as defined in claim 60, further comprising:

a retainer cap secured to the tool body and having a cap hole in communication with the body hole; and a plurality of securing members for securing the retainer cap to the tool body.

66. The downhole jetting tool as defined in claim 60, further comprising:

a plurality of radially movable jetting nozzles each positioned within a respective laterally extending body hole, each of the plurality of jetting nozzles being circumferentially spaced approximately equidistant apart on the tool body about the central body axis; and a plurality of replaceable spacers each for limiting radially outward movement of a respective jetting nozzle.

67. The downhole jetting tool as defined in claim 60, further comprising:

at least one frangible member for engaging the jetting nozzle to prevent premature radial movement of the jetting nozzle to the radially outward position.

68. A downhole jetting tool for positioning within a well bore from a workstring for abrasive fluid jetting a surface, the jetting tool comprising:

a tool body including an upper end for interconnection with the workstring, the tool body having a central body axis;

the tool body including an extending passageway in fluid communication with the workstring, a laterally extending body hole extending radially from the axially extending passageway to an exterior surface of the tool body, and a cavity spaced axially opposite the upper end of the tool body with respect to the body hole;

a radially movable jetting nozzle positioned within a laterally extending body hole for jetting fluid from the axially extending body passageway onto the surface, the jetting nozzle being radially movable from a radially inward position to a radially outward position, the jetting nozzle having a jetting nozzle axis and the jetting nozzle when in the radially inward position is intersected by the central body axis; and a jetting nozzle support for pivotally supporting the jetting nozzle on the tool body such that the axis of the jetting nozzle may be pivotally adjusted from a jetting position wherein the jetting nozzle axis is substantially normal to the central body axis to a jetting tool retrieval position wherein the jetting nozzle is pivoted such that a radially outward end of the jetting nozzle is with the cavity.

69. The downhole jetting tool as defined in claim 68, wherein:

the jetting nozzle support is a ball member pivotally movable within the tool body; and a seal for maintaining engagement between the tool body and an outer surface of the ball member during pivotable movement of the ball member with respect to the tool body.

70. The downhole jetting tool as defined in claim 68, further comprising:

a frangible member for engaging the jetting nozzle to prevent premature radially movement of the jetting nozzle to the radially outward position.

71. The downhole jetting tool as defined in claim 68, wherein:

the axially extending body passageway defined an annular seat for receiving a closure member for at least substantially shutting off fluid flow from the tool body; and the closure member may be raised off the annular seat by reverse fluid circulation through the tool body.

72. The downhole jetting tool as defined in claim 68, further comprising:

a plurality of jetting nozzles each positioned within a respective laterally extending body hole, each of the plurality of jetting nozzles being circumferentially spaced approximately equidistant apart on the tool body about the central body axis.

73. A downhole jetting tool for positioning within a well bore from a workstring for abrasive fluid jetting a surface, the jetting tool comprising:

a tool body including an upper end for interconnection with the workstring, the tool body having a central body axis;

the tool body including an extending passageway in fluid communication with the workstring and a laterally extending body hole extending radially from the axially extending passageway to an exterior surface of the tool body;

a jetting nozzle positioned within a laterally extending body hole for jetting fluid from the axially extending body passageway onto the surface, the jetting nozzle being radially movable from a radially inward position wherein the jetting nozzle is housed substantially within the tool body to a radially outward position herein a jet nozzle discharge aperture is radially exterior of the tool body; and a frangible member for engaging the jetting nozzle to prevent premature radial movement of the jetting nozzle to the radially outward position.

74. The downhole jetting tool as defined in claim 73, wherein the frangible member is a shear pin selectively sized for shearing in response to fluid pressure in the axially extending body passageway.

75. The downhole jetting nozzle as defined in claim 73, wherein the jetting nozzle when in the radially inward position is intersected by the central body axis.

76. The downhole jetting nozzle as defined in claim 73, wherein the jetting nozzle has a radially exterior surface positioned radially inward of an exterior surface of the tool body when the jetting nozzle is in the radially inward position.

77. The downhole jetting tool as defined in claim 73, further comprising:

a replaceable spacer for selectively limiting radially outward movement of the jetting nozzle with respect to the tool body.

78. The downhole jetting tool as defined in claim 73, further comprising:

a plurality of jetting nozzles each positioned within a respective laterally extending body hole, each of the plurality of jetting nozzles being circumferentially spaced approximately equidistant apart on the tool body about the central body axis.

79. A downhole jetting tool for suspending within a well bore from a workstring, the elongate tool body having a central body axis;

the tool body including an extending passageway in fluid communication with the workstring and a laterally extending body hole extending radially from the axially extending passageway to an exterior surface of the tool body;

a radially movable jetting nozzle positioned within the laterally extending body hole for jetting fluid from the axially extending body passageway onto the surface, the radially movable jetting nozzle having a jet nozzle aperture for discharging fluid from the jetting nozzle onto the surface; and the jetting nozzle being radially movable with respect to the tool body and within the body hole from a radially inward position wherein the jetting nozzle is at least substantially housed within the tool body to a radially outward position wherein the jet nozzle aperture is at least substantially exterior of the tool body; and the jetting nozzle including a plurality of jetting nozzle extenders telescopingly arranged within the laterally extending body hole, each of the plurality of jetting nozzle extenders including an upstream end having a frustoconical upstream surface for minimizing turbulent flow through the jetting nozzle.

80. The downhole jetting tool as defined in claim 79, further comprising:

a replaceable spacer for selectively limiting radially outward movement of the jetting nozzle with respect to the tool body.

81. The downhole jetting tool as defined in claim 79, further comprising:

a plurality of jetting nozzles each positioned within a respective laterally extending body hole, each of the plurality of jetting nozzles being circumferentially spaced approximately equidistant apart on the tool body about the central body axis.

82. The downhole tool as defined in claim 79, further comprising:

a jetting nozzle support for pivotally supporting the jetting nozzle on the tool body such that an axis of each jetting nozzle may be pivotally adjusted within the laterally extending body hole; and the tool body includes a cavity axially opposite the body upper end with respect to the body hole for receiving the jetting nozzle when the axis of the jetting nozzle is substantially inclined relative to an axis normal to the tool body axis, such that the jetting nozzle may be pivoted into the cavity for retrieving the downhole jetting tool.

* * * * *